US006352622B1

(12) United States Patent
Brown et al.

(10) Patent No.: US 6,352,622 B1
(45) Date of Patent: Mar. 5, 2002

(54) LEAD ELECTRODE

(75) Inventors: Carl W. Brown, Leroy Township; Jeries I. Bishara, Mentor; Lynne M. Ernes, Willoughby; Andy W. Getsy, Eastlake; Kenneth L. Hardee, Middlefield; Barry L. Martin, Concord; Gerald R. Pohto, Mentor; Thomas J. Schue, Huntsburg; Thomas R. Turk, Mentor, all of OH (US)

(73) Assignee: Eltech Systems Corporation, Chardon, OH (US)

( * ) Notice: Subject to any disclaimer, the term of this patent is extended or adjusted under 35 U.S.C. 154(b) by 0 days.

(21) Appl. No.: 09/660,873

(22) Filed: Sep. 13, 2000

Related U.S. Application Data

(62) Division of application No. 09/273,981, filed on Mar. 22, 1999, now Pat. No. 6,139,705.

(60) Provisional application No. 60/084,396, filed on May 6, 1998.

(51) Int. Cl.[7] ..... C25B 9/00

(52) U.S. Cl. ..... 204/242; 204/284; 204/278.5; 204/286; 204/288; 204/290.01; 204/290.12; 204/290.13

(58) Field of Search ..... 204/284, 286, 204/288, 290.01, 290.12, 290.13, 242, 252, 278.5

(56) References Cited

U.S. PATENT DOCUMENTS

| | | | | |
|---|---|---|---|---|
| 3,855,084 A | | 12/1974 | Feige, Jr. | 204/280 |
| 3,915,837 A | | 10/1975 | Feige, Jr. | 204/286 |
| 4,260,470 A | | 4/1981 | Fisher | 204/286 |
| 4,425,217 A | | 1/1984 | Beer | 204/290 R |
| 4,437,948 A | * | 3/1984 | Okinaka et al. | 204/290.01 |
| 4,543,174 A | | 9/1985 | Beer et al. | 204/290 R |
| 4,543,348 A | | 9/1985 | Beer et al. | 204/290 F |
| 5,172,850 A | * | 12/1992 | Prengaman et al. | 29/460 |
| 5,783,058 A | | 7/1998 | Fowler et al. | 204/290 R |
| 6,120,658 A | * | 9/2000 | Dunn et al. | 204/282 |
| 6,129,822 A | * | 10/2000 | Ferdman | 204/288 |

FOREIGN PATENT DOCUMENTS

| | | |
|---|---|---|
| DE | 0 681 038 A1 | 11/1995 |
| EP | WO 97/06291 | 2/1997 |
| EP | 0 892 086 A1 | 1/1999 |
| EP | WO 96/34996 | 1/1999 |

OTHER PUBLICATIONS

Manufacture Specifications of the Diaphragm cell with Metal Anodes, Sep. 12, 1988.

* cited by examiner

*Primary Examiner*—Bruce F. Bell
(74) *Attorney, Agent, or Firm*—Michele M. Tyrpak; Hudak & Shunk

(57) ABSTRACT

A compound electrode incorporating a lead substrate utilizes the lead as a support structure. This support structure provides a surface that engages a valve metal expanded metal mesh. The mesh member has a front and back surface with the back surface facing the lead support structure. At least the front surface of the mesh member is an active surface. Securing of the mesh member to the lead support structure in electrical connection permits the lead support structure to serve as a current distributor for the mesh member. The mesh member may engage the surface of the lead support structure by pressing or rolling the mesh onto the lead. Other engagement means can include the use of fasteners, or welding and the like. The resulting structure can be particularly useful as an electrode assembly for use in an electrolytic cell that serves for the electrowinning of a metal.

49 Claims, 7 Drawing Sheets

LEAD ELECTRODE

CROSS REFERENCE

This is a divisional application of Ser. No. 09/273,981 filed on Mar. 22, 1999 of Carl W. Brown Jr., et al., for IMPROVED LEAD ELECTRODE, now U.S. Pat. No. 6,139,705.

This application claims the benefit of U.S. Provisional Application No. 60/084,396, filed May 6, 1998.

FIELD OF THE INVENTION

A compound electrode relying on lead is disclosed. The lead can form a base for the electrode. The active surface for the compound electrode may comprise valve metal. The electrode is particularly serviceable in an electrolytic cell used for electrowinning of a metal.

BACKGROUND OF THE INVENTION

Historically, lead or lead alloy anodes have been widely employed in processes for the electrowinning of metals, such as copper, from sulphate electrolytes. These lead anodes nevertheless have important limitations such as undesirable power consumption and anode erosion. This anode erosion can lead to sludge production and resulting contamination of one or both of the electrolyte and the electrowon product.

During the time that these lead electrodes have been in use, a major breakthrough in anode advancement led to the development of the dimensionally stable anode, principally for use in the chlor-alkali industry. This anode relied typically on a coated valve metal. There then followed attempts to utilize concepts behind this advance so as to devise an improved lead electrode such as for copper electrowinning.

One conceptual approach was to unite in some way the desirable characteristics of a valve metal, e.g., the excellent acid resistance of a valve metal such as titanium, with the desirable features of the conventional lead anodes, including the presence of an oxide that can be an electroconductor. Using this approach, it was proposed to make a composite anode from a sintered article of one metal, e.g., the titanium, which article is infiltrated with the other metal, i.e., the lead. These anodes have been proposed, for example, in U.S. Pat. No. 4,260,470. The titanium can be ground, compressed and sintered to prepare a titanium sponge as a porous matrix. This matrix is then infiltrated with molten lead or lead alloy. The object is first to provide planar anodes in the form of strips. The strips are then joined together in a parallel, co-planar array to provide a large sheet anode.

The patent teaches employing these anodes particularly for use in electrowinning zinc or copper from sulfate electrolytes. However, if the sintered metal is infiltrated with lead, under the anodic conditions that are present such as in a copper electrowinning cell, the lead is anodically oxidized to lead dioxide. Thus, the anode can present loss of lead to the electrolyte, with resultant sludge build-up, and/or require electrolyte additives to deter such loss. Therefore, these anodes are ostensibly better suited for use in lead-acid batteries. Such utility has been disclosed in U.K. Patent Appln. No. 2,009,491A. In any event, there is today no known utilization of these anodes commercially such as in the copper electrowinning industry.

It has also been proposed to retain the commercially acceptable lead anodes, while fully utilizing the technical advance of the coated valve metal development. To this end, ways have been considered as to how to shield the lead from electrolyte, so as to reduce, to eliminate, lead erosion. Thus, it has been proposed to prepare catalytic particles of a metal such as titanium, which particles are activated with a platinum group metal. These particles are then uniformly distributed over, and partly embedded within, the surface of an anode base of lead or lead alloy. The lead plate is thus covered with a layer of these particles, such as of activated titanium sponge particles. Such an anode has been disclosed in U.S. Pat. No. 4,425,217. Therein it is taught that the anode offers improved electrochemical performance for anodically evolving oxygen in an acid electrolyte, and use is taught such as in the electrowinning of metals. However, it was found to be uneconomically viable to scale up this concept and to provide a uniform layer of small particles on the surface of commercial lead electrodes. In working with a multitude of particles, it was further found that the resulting article was difficult to refurbish. As a result, there is no known commercial use today of this anode.

Despite these developments, there then has not yet been found a commercially practicable anode, as a replacement for lead or lead alloy anodes, in industries such as copper electrowinning from sulfate electrolyte. Even today, decades after the development of the dimensionally stable anode for use in the chlor-alkali industry, the anode of choice for copper electrowinning is still the historical lead or lead alloy anode. There is thus a need for an anode, particularly for electrowinning of a metal, which is serviceable for extended stable operation. As an example of this need, even today it is not unusual to remove from 80 to 100 pounds of sludge, comprised principally of lead oxide and lead sulfate, after only about a week of operation, from a single commercial copper electrowinning cell that uses lead anodes. There is not only still the need for a commercially practicable as well as stable anode, but also the need for one which can be readily prepared for reuse and, in reuse, provide similar, extended operation. Therefore, it would be desirable to provide an anode, as either a fresh or refurbished anode structure, having stability, economy of operation, and economy of preparation as a fresh or refurbished structure.

SUMMARY OF THE INVENTION

There is now provided a compound electrode, particularly for electrowinning of a metal, which is serviceable not only for extended operation, but which can be readily prepared for reuse and, in reuse, provides similar, extended operation. The compound electrode is provided with either a fresh or refurbished lead electrode segment, having economy of preparation as a fresh, or as a refurbished, item. This lead compound electrode can have desirably low operating voltage and can offer enhanced current density in cell operation. It can serve to minimize or eliminate loss of lead to the electrolyte, which usually proceeds due to electrochemical oxidation as well as erosion of the lead. For convenience, such oxidation plus erosion may more simply be referred to herein as lead "corrosion". This innovative compound electrode can thus provide for desirable electrolyte cleanliness as well as product cleanliness. The electrode can provide for further operating economy such as by reducing to eliminating the need for electrolyte additives, e.g., the elimination of the use of cobalt addition in a copper electrowinning bath. The compound electrode can not only be easy to assemble as a fresh electrode, but also can be spot repaired and, in refurbishing, such may be done by field installation.

In a first aspect, the invention is directed to a compound electrode for electrowinning a metal present in an electrolyte in an electrolytic cell by partially submersing the electrode in the cell electrolyte, such electrode comprising a thin and solid lead electrode base and at least one thin valve metal surface member in mesh form, which lead base is in sheet form and has broad, essentially rectangular front and back surfaces as well as narrow side and bottom surfaces, with each front and back surface having at least substantially parallel side edges, as well as having top and bottom edges, with the electrode comprising exposed lead side surfaces as well as exposed front and back surface portions above an electrolyte-air interface of the cell, and which metal mesh surface member has a multitude of voids exposing the lead base underlying these voids, with the valve metal mesh surface member extending at least substantially from side edge to side edge across at least one of the broad front and back surfaces of the base, while extending from below the top edge of the base, but above said electrolyte-air interface of the cell, to at least substantially the bottom edge of the lead base, which valve metal mesh surface member has a front, active major face presenting an electrochemically active surface in mesh form for the compound electrode, and a back major face which faces a broad surface of the lead base, and wherein the mesh surface member is combined with the lead base in electrically conductive contact.

In one aspect, the invention is directed to a compound electrode comprising an electrode base of lead or lead alloy and a valve metal mesh member combined with the lead electrode base, which lead base is in sheet form and has a large broad surface, and which valve metal mesh member has a multitude of voids and is in electrically conductive contact with the lead base, which valve metal mesh member is in sheet form and has a front, coated major face and a back major face, with the back major face of the valve metal mesh member facing the lead base and wherein the mesh member is combined with the lead base in electrical contact, whereby a substantial portion of the lead base broad surface is retained in exposed form by the multitude of mesh member voids, while the valve metal mesh member at the broad surface projects a coated face from the lead base and presents an active surface in mesh form for the compound electrode.

In a related aspect, the invention is directed to a compound electrode as is generally described in the paragraph immediately hereinabove, but having a metal mesh member that may be other than a valve metal mesh member, which member may not be coated and can include a platinum group metal mesh member.

In another related aspect, the invention relates to an electrolytic cell containing a compound electrode as described hereinabove.

In another aspect, the invention relates to the method of providing an electrode assembly, which assembly has a lead base useful in an electrochemical process, such lead base being spaced apart in the cell from a cell electrode, with a gap maintained therebetween for containing an electrolyte, which method comprises:

establishing the lead base with a broad surface whereby the lead base serves as an assembly support structure;

establishing a mesh member with a broad front face and a broad back face;

coating the mesh member front face to provide an active front face;

combining the mesh member with the lead support structure, with the mesh member broad back face facing the broad surface of the lead support structure;

securing the mesh member to the lead support structure in electrically conductive engagement for forming the electrode assembly; and electrically connecting the lead support structure of the electrode assembly to a power supply, the support structure serving as a current distributor member for the mesh member.

In another aspect, the invention pertains to an apparatus for electrodepositing a metal from an electrolyte, the apparatus having a cathode, an anode spaced from the cathode providing a gap containing the electrolyte therein, wherein an apparatus electrode has an active electrode member plus a support structure, the apparatus comprising:

a stationary and rigid lead support structure for the apparatus electrode, which lead support structure has a broad surface;

a flexible mesh member for the apparatus electrode, which mesh member has a broad, coated front face and broad back face, with the broad back face of the mesh member facing the broad surface of the lead support structure;

means securing the mesh member to the lead support structure in electrically conductive engagement, the securing means providing inflexible positioning of the mesh member in relation to the lead support structure; and power supply means providing electrical power to the lead support structure whereby the lead support structure serves as an electrically conductive current distributor member for the mesh member.

Previously, where it has been desired to use the lead as an electrode base, it has been the practice to cover the operative surface of the lead base. This may be accomplished with a layer of uniformly distributed particles. It can also be done with a sheet anode which may be in strip form. These arrangements have been discussed hereinabove. It has now, however, been found that such full coverage of the lead base is not necessary. The compound electrode structure of the present invention with an open mesh member can achieve desirable electrolytic activity, and achieve this activity without deleterious lead contamination in the electrolyte. This can be obtained even for the compound electrodes wherein the mesh members, with their inherent void fraction, leave exposed a very substantial portion of the lead base. As representative, where mesh members leave exposed on the order of about 50 percent of the lead base surface area over which the mesh extends, nevertheless lead contamination in cell electrolyte may be reduced by as much as 95 percent, or even more, by the innovative compound electrode.

Furthermore, as is the case for lead anodes utilized in copper electrowinning, the compound electrode can be completely retrofittable. No redesign of cell electrical systems may be needed and existing buss connections can be retained. Also, for cell electrolytes, it can be possible to maintain existing compositions and flow rates, although it is contemplated that less expensive compositions may be achieved through the reduction to elimination of electrolyte additive.

DESCRIPTION OF THE PREFERRED EMBODIMENTS

Figure 1:
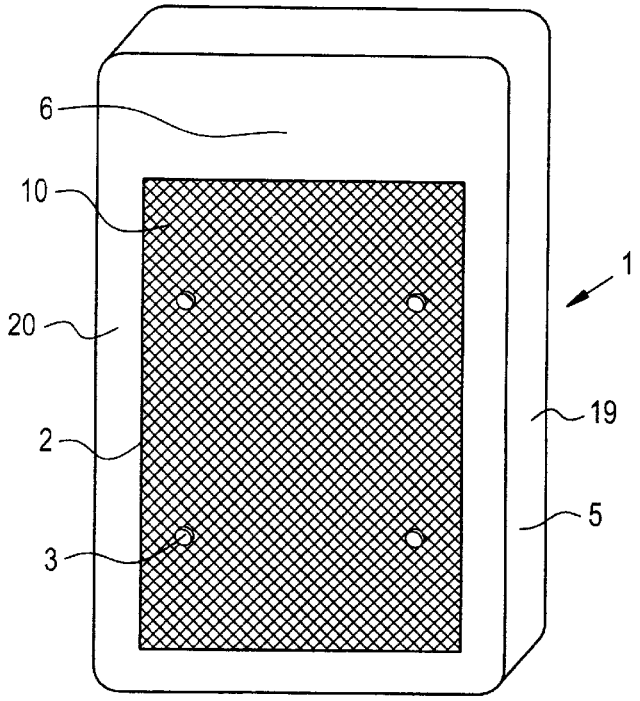
FIG. 1 is a perspective view of a compound electrode structure having a fine mesh on the front face of an electrode core member.

The electrolytic cells employing the present invention are particularly useful in electrowinning, e.g., a cell for the recovery of copper from a sulfate electrolyte. Other metals typically recovered in electrowinning cells include cobalt, zinc, nickel, manganese, silver, lead, gold, platinum, palladium, tin, chromium and iron. The electrode described herein when used in such an electrowinning cell will virtually always find service as an anode. Thus, the word "anode" is often used herein when referring to the electrode, but this is simply for convenience and should not be construed as limiting the invention. Since the electrode will have a base and a mesh member, it is sometimes referred to herein for convenience as a "compound electrode" or the like, e.g., "compound anode", or as an "electrode structure". Where the electrode is in further combination, such as with electrical connection means, which can be associated with a power supply, the further combination may be referred to herein as an "electrode assembly".

The support structure, or "base", for the electrode is a base of lead or alloys of lead, such as lead alloyed with tin, silver, antimony, calcium, strontium, thallium, indium, lithium or tellurium. The alloy can be an alloy rich in lead, i.e., containing at least about 50 weight percent lead and more advantageously, above about 95 weight percent lead. The base for the electrode may be an intermetallic mixture that includes lead. A representative mixture could be lead mixed with cobalt. The base, which may be supplied as a used electrode that has been utilized in an electrochemical process, such as any of the processes that are mentioned herein in connection with discussions of electrolytic cells, may be somewhat soluble or corroded in the electrolyte of the cell. The lead base is usually in a flat sheet form and the sheet is a solid sheet. However, other forms are contemplated. Thus, for example, the lead base may have a cylindrical form or the like, such as elliptical. In such a form the lead base can present a major cylindrical face or the like, to which a mesh member can be secured. Still other forms of the lead base may include a perforate base and form a flow-through electrode. As a sheet form base, the sheet will usually have a thickness within the range of from about ⅛ inch to about 2 inches, but some lead base electrodes can have thickness of up to about 2 feet or more.

The compound electrode also includes a mesh member which may sometimes be simply referred to herein as the "mesh". The terms "mesh member", or "member in mesh form" or the like, as such are used herein will be more particularly discussed hereinbelow, such as in connection with the drawings. The metals of the electrode mesh member will most always be valve metals, including titanium, tantalum, zirconium, niobium and tungsten. Of particular interest for its ruggedness, corrosion resistance and availability is titanium. As well as the normally available elemental metals themselves, the suitable metals of the mesh member can include metal alloys and intermetallic mixtures. For example, titanium may be alloyed with nickel, cobalt, iron, manganese, copper or palladium. Although it is contemplated that the metal will virtually always be coated, for some mesh members, e.g., of platinum or a platinum group metal, coating may be avoided. Thus, uncoated mesh members may be made of metals, such as platinum, or the other metals of the platinum group including palladium. It is also to be understood that the coated metals can include coated metals such as a platinized valve metal substrate, e.g., platinized titanium and platinized niobium, as might be prepared by means of chemical vapor deposition or by plating.

By use of elemental metals, it is most particularly meant the metals in their normally available condition, i.e., having minor amounts of impurities. Thus, for the titanium metal of particular interest, various grades of the metal are available including those in which other constituents may be present in alloy form or as alloys plus impurities. Grades of titanium have been more specifically set forth in the standard specifications for titanium detailed in ASTM B 265-95.

Because it is a metal of particular interest, titanium will often be referred to herein for convenience when referring to metal for the metal mesh. In this regard, titanium in sheet form can be expanded to prepare a mesh. For this, titanium in sheet form may proceed through a piercing and pulling metal working operation. Although it is contemplated that the mesh may take other forms, e.g., a coil, it will be understood that the mesh member is most useful in flat sheet form. Thus, for convenience, reference is usually made herein to the mesh "sheet" or "sheet form" mesh, or the like. The mesh can be useful in the form provided by the metal working operation as unflattened, expanded metal mesh in sheet form. Depending upon the mesh desired, expansion of the sheet may vary from a slight expansion, such as providing on the order of as little as about 5 or 10 percent, or up to 25 percent open area, up to a greatly expanded mesh member, such as will provide about 85 or 90 percent or more of open area.

As mentioned hereinabove, the mesh member can be useful in the form provided by the metal expander, which form is referred to herein as "unflattened", or it may be flattened after expansion. As will be understood by reference to the FIGS. 1–9 depicting several forms of mesh, all varieties of mesh are contemplated as being useful in the present invention. Certain representative varieties for the mesh member as may be particularly serviceable for the electrode have been shown in the FIGS. 1–4.

Figure 5:
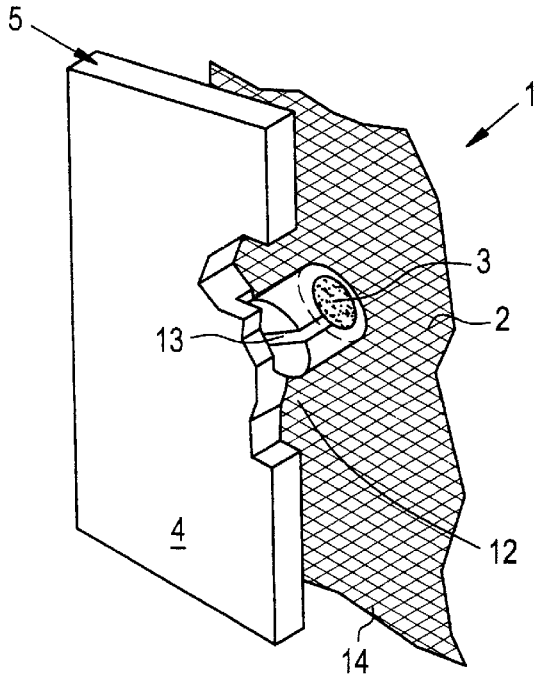
FIG. 5 is a perspective view of a mesh connected to an electrode core member using a split fastener that is welded to the mesh and pressed into the core member.

Referring then to FIG. 1, there is disclosed a compound electrode 1, which may also be referred to herein for convenience as an electrode assembly 1, having a mesh member 2, or just "mesh" 2, that may be an expanded metal mesh member 2. It can be expanded from a sheet that is in foil form, so that the mesh member 2 is a "fine" mesh 2 and has dimensions which can be associated with those of a window screen. The mesh member 2 has substantially rhombus shaped voids. The void pattern is outlined in a continuous network of metal strands. The mesh 2 is affixed, such as by means of spot welds 3, so that the back face 14 (FIG. 5) of the mesh 2 is secured to a lead support member, or base, 5. The front face 10 of the mesh 2 is then left exposed. This lead support member 5, typically plate-shaped, provides a large broad surface 6, or front major face 6 and a back major face 4 (FIG. 5). The front and back faces 6, 4 are often flat, or at least substantially flat. The like faces 10 and 14 (FIG. 5) of the mesh 2 are similarly configured. The plate-shaped base 5 can have edge surfaces 19, which may be left exposed, as well as typically having a substantially rectangular shape, e.g., for the front face 6 as depicted in the figure. The base 5 is generally at least substantially thicker than the mesh 2, as has been depicted in the figure. The mesh 2 can be sized to fully extend across the entire face 6 of the base 5, or may be sized so as not to cover the entire face 6 of the base 5, i.e., the face 6 may be enlarged in area over the area of the front face 10 of the mesh 2, leaving an exposed edge surface 20 of the front face 6. In either case, the face 6 of the base 5 is exposed at the voids of the mesh 2.

For the fine mesh 2 of FIG. 1, the thickness of the starting metal toil can be quite small, e.g., on the order of about 0.005 inch, resulting in a fine mesh 2 of the same 0.005 inch thickness. Generally, the fine mesh 2 will have a thickness within the range of from about 0.0025 inch to about 0.025 inch, and thus the strands 8 (FIG. 2) of the mesh will have such thickness. These strands 8 can have width of comparable size to their thickness. Each void has a short way of design, or SWD dimension, as well as a long way of design, or LWD dimension. For the fine mesh 1, the SWD dimension is about 0.06 inch. The LWD dimension for the voids is about 0.125 inch. Such dimensions, besides providing for great flexibility for the fine mesh 2, provide for stretchability. The fine mesh 2, when it is expanded from a foil of metal, is a continuous network of strands. When it is provided from wires, it can be a woven wire screen with voids that need not be rhombus shaped. The form of the continuous network of strands is preferred, not only for economy but also to most desirably provide a continuous electrical path. In FIG. 1, the lead base 5 may be a single, solid plate. The base 5 may be a fresh lead plate which is to be placed in service, or can be supplied by a plate which has been used in service, as in an electrolytic cell. For a used lead base 5, the front face 6 can be a freshly prepared face 6. This front face 6 can be configured to face another electrode (not shown). The base 5 is of lead or lead alloy, as has been described hereinabove. A power supply means (not shown) is connected to the base 5, whereby the base 5 can serve as a current distributor for the mesh member 2. Where the facial surface 20 of the face 6 is not covered by the mesh 2, which facial surface 20 will typically be positioned around the outer periphery of the mesh 2, it can be left uncovered or it may be covered by a sealing member (not shown), e.g., a non-conductive polymeric strip around the mesh to cover the exposed facial surface 20 of the face 6.

Figure 2:
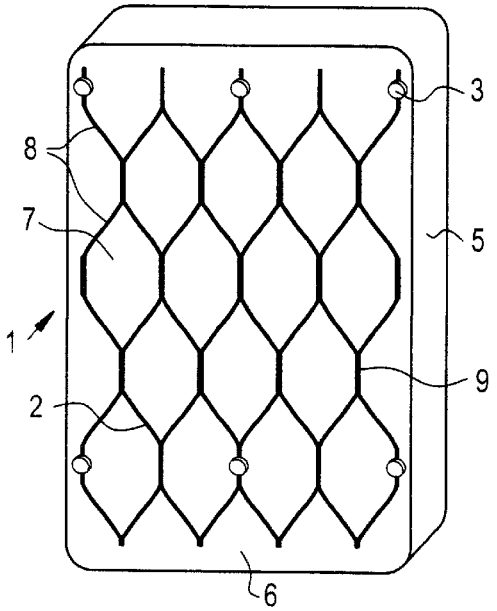
FIG. 2 is a perspective view of the electrode core member of FIG. 1 having on its front face a medium diamond mesh.

FIG. 2 shows a compound electrode 1 having an expanded mesh member 2, in a planar form, that is a medium diamond mesh having diamond shaped voids 7. Each void 7, in the orientation depicted in the figure, has an LWD in the vertical direction and an SWD in the horizontal direction. Each void 7 exposes a substantial portion of the face 6 of the underlying lead base 5. The void pattern is outlined in a continuous network of metal strands 8. The metal strands 8 will typically have a width within the range from about 0.01 inch to about 0.06 inch or more. The strands 8 merge into double-strand-width nodes 9. The nodes 9 have a width within a range from about 0.02 inch to about 0.12 inch. The diamond shaped voids 7 may have an SWD dimension of as much as about 0.5 inch and an LWD dimension that may be as much as about one inch. The sheet of mesh 2 is secured by spot welds 3 to the broad front face 6 of the lead support member 5.

Figure 3:
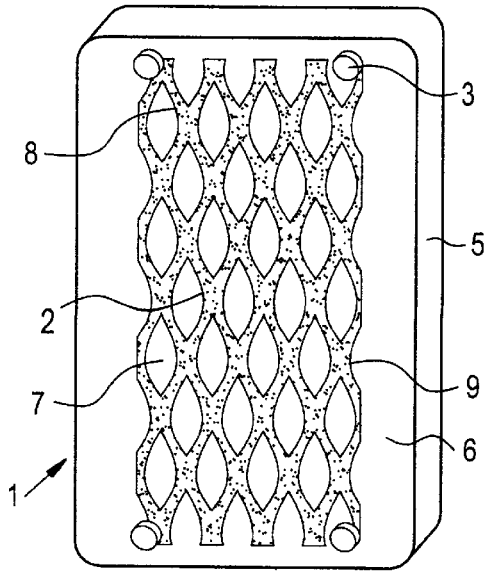
FIG. 3 is a perspective view of the electrode core member of FIG. 1 having on its front face a mesh of modest expansion that has thick strands and modestly sized voids.

FIG. 3 shows a compound electrode 1 bearing a representative expanded mesh member 2, in a planar form, that has a pattern of substantially long and narrow, modestly-sized voids 7. As shown in the figure, each void 7 has an LWD in the vertical direction and an SWD in the horizontal direction. Each void 7 exposes a portion of the face 6 of the underlying lead base 5. The void pattern is outlined in a continuous network of wide metal strands 8. Hence, this mesh member 2 may be referred to herein for convenience as the "wide" mesh 2.

The metal strands 8 will typically have a width within the range from about 0.04 inch to about 0.1 inch. The strands 8 merge into double-strand-width nodes 9. The nodes 9 have a width within a range from about 0.08 inch to about 0.2 inch. The somewhat oval-shaped voids 7 may have an SWD dimension within the range of from about 0.2 inch to about 0.25 inch and an LWD dimension within the range of from about 0.3 inch to about 0.5 inch.

The thickness of the metal may be thin, e.g., on the order of less than about 0.05 inch, resulting in a sheet of mesh 2 having strands 8 that are less than about 0.05 inch in thickness. Generally, the mesh strands 8 will have a thickness in the range of from about 0.02 inch to about 0.03 inch. The sheet of mesh 2 is secured, such as by means of spot welds 3, to the broad front face 6 of a lead support member 5. The support member 5 is typically at least substantially thicker than the mesh 2. Also, this mesh 2 is sized to only partially cover the face 6 of the lead support member 5.

Figure 4:
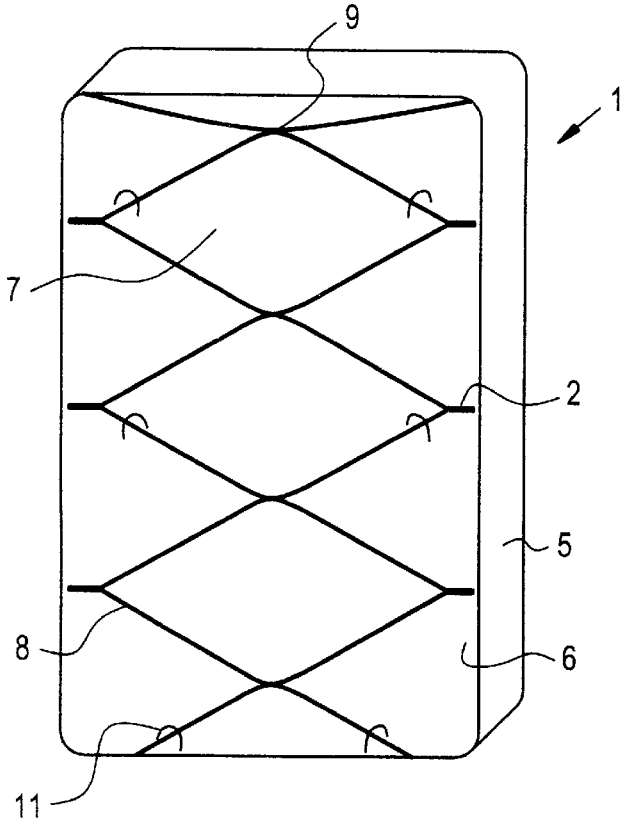
FIG. 4 is a perspective view of the electrode core member of FIG. 1 depending from a steer horn conductor bar, with the core member having on its front face a greatly expanded mesh of thin strands and large void size.

Referring then to FIG. 4, the mesh 2 for the compound electrode 1 is produced by expanding a sheet of metal by an expansion factor of approximately 30 times its original area. The resulting expanded mesh 2 has an at least 80 percent void fraction. Strands 8 have thickness that can be from about 0.02 inch to about 0.05 inch, with a strand width dimension of from about 0.02 inch to about 0.08 inch. The strands 8 merge into double thickness nodes 9. The voids 7 have a horizontal long way of design (LWD) from about 1.5, and preferably from about 2.4 inches up to about 3.5 inches, and a vertical short way of design (SWD) of from about 0.8, and preferably from about one, up to about 1.5 inches. The mesh 2 is secured by brads 11 on the broad front face 6 of a lead support member 5. The support member 5 is interengaged with, and depends downwardly from, a steer horn conductor bar 15A.

Referring next to FIG. 5, the back face 14 of a mesh member 2 for the compound electrode 1 is secured to a split fastener 12, sometimes referred to herein as a "split nail" 12, by means of a spot weld 3. The split fastener 12 has a slot 13. On embedding of the split fastener 12 into the front face of the lead base 5, the slot 13 assists in providing a tight grip for the fastener 12 with the base 5. The fastener 12 does not protrude through to the back face 4 of the lead base 5.

Figure 6:
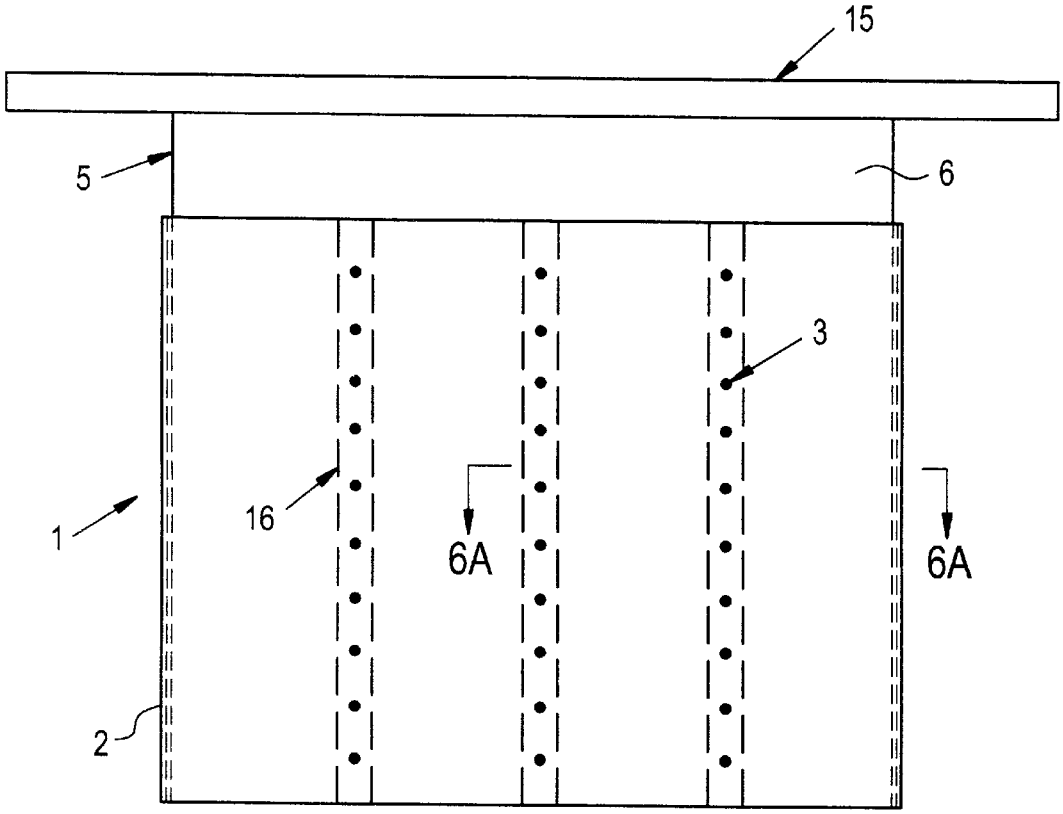
FIG. 6 is a plan view of an electrode core member, with conductor bar, wherein the core member has a mesh envelope that contacts the core member through a series of contact strips.

FIG. 6 shows a compound electrode 1 having a lead base 5 that is suspended from a conductor bar 15. The lead base 5 is partially enveloped in a mesh member 2.

The top of the mesh member 2 is spaced below the conductor bar 15, thereby exposing a portion of the front face 6 of the lead base 5. The balance of the front face 6 as well as the edge surfaces 17 (FIG. 6A) and back face 4 (FIG. 6A) of the lead base 5 are enveloped by the mesh member 2. This mesh member 2 is set apart from, but maintained in electrical contact with, the lead base 5 by a series of parallel contact strips, or louvers, 16 shown in FIG. 6 in phantom lines. These contact strips 16 are secured to the back face 14 (FIG. 6A) of the mesh member 2 by spot welds 3. The contact strips 16 can engage the lead base 5, e.g., on the front face 6, such as by pressing into the face 6 of the lead base 5.

Figure 6A:
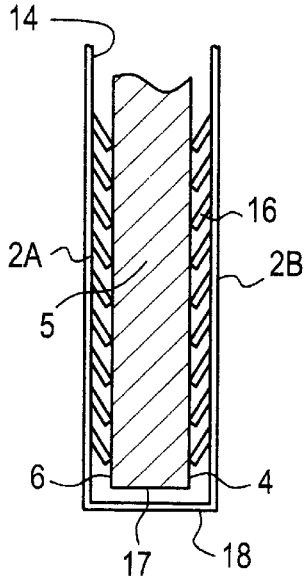
FIG. 6A is a sectional view along the lines 6A—6A of FIG. 6.

As shown in FIG. 6A, there may be a great multitude of the contact strips 16, and these can be located at both the front face 6 and back face 4 of the lead base 5. The mesh member 2 of envelope shape may extend across these faces 4, 6 as well as have one or more side sections 18 plus extend across the bottom of the lead base 5. Thus, the mesh member 2 of envelope shape can have a front mesh member 2A and back mesh member 2B as well as one or more side sections 18 and may have a bottom section. Placement of contact strips 16 between the lead base side surface 17 and one or more of the mesh member side sections 18 is optional.

Figure 7:
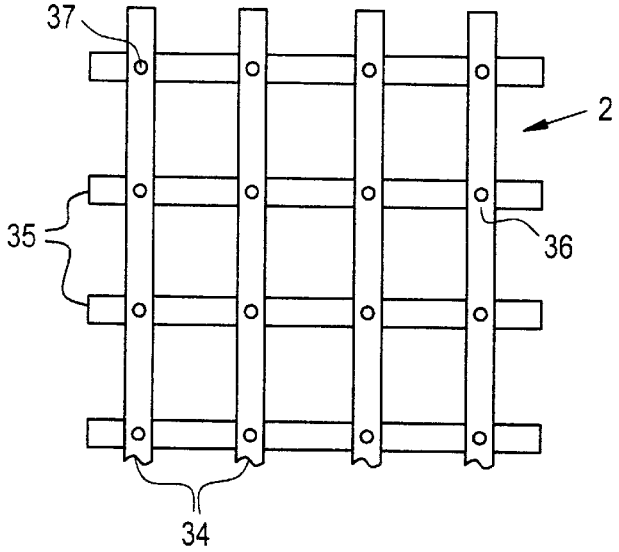
FIG. 7 is a plan view of the front face of a ribbon mesh for use on a face of an electrode core member.

As has been mentioned hereinbefore, the mesh can be an expanded metal mesh or may be provided from wires, e.g., in woven wire form. The mesh may be present in layers and the layered mesh can include meshes of all the same or of different configurations. For example, many layers of the fine mesh 2 of FIG. 1 might serve as a layered mesh. Or, a layer of the fine mesh 2 of FIG. 1 might be under a layer of the more expanded mesh 2 which is depicted in FIG. 2. As discussed hereinbelow, other forms of mesh to provide the mesh member 2 are contemplated. One such form comprises metal strips or ribbons. The strips or ribbons may be solid or may be perforate. They can have a width dimension greater than wire and the strips may be interconnected as in a grid form. A representative mesh prepared in this manner is depicted in FIG. 7. However, the grid form mesh may be otherwise arranged, e.g., by having mesh strips intersecting at other than a 90° angle, or by having mesh strips arranged in a random orientation rather than a pattern as shown in the figure. Strips interconnected in a grid form are representative of a "metal strip assembly" as such term is used herein.

Referring now to FIG. 7, a series of parallel, spaced apart, first metal strips 34 are connected by a similar series of parallel, spaced apart, second metal strips 35. The strips 34, 35 as depicted in FIG. 7 are solid metal strips. In this representative arrangement, the strips 34, 35 are placed at right angles. Also, by this arrangement, a mesh member 2 is provided from the metal strips 34, 35. At the crossings of these strips 34, 35, the strips form nodes 36 and at these nodes 36 the strips 34, 35 can be secured together, e.g., by spot welds 37. When the mesh 2 of FIG. 7 is assembled, and preferably after it is coated on at least its front face, the mesh can be applied on the face 6 of a lead support member 5, as is discussed more particularly hereinbelow.

Figure 8:
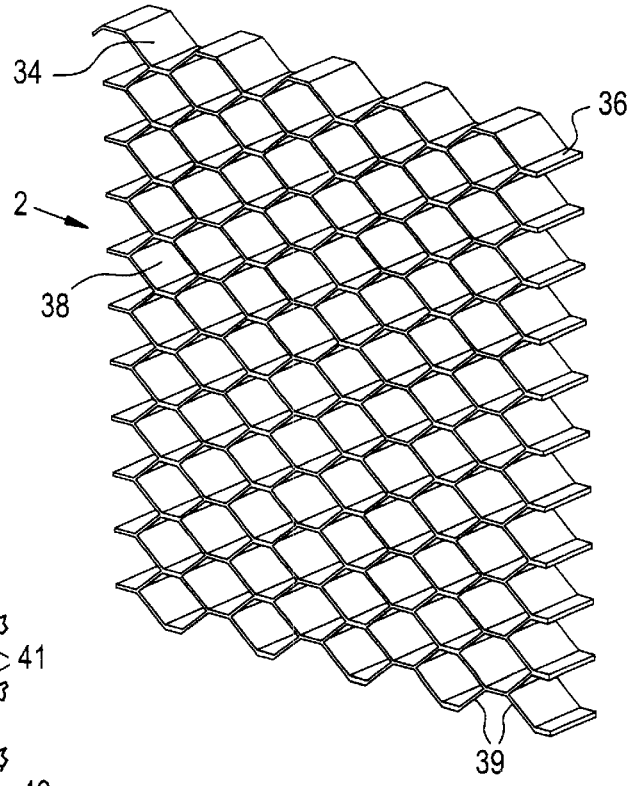
FIG. 8 is a perspective view of a ribbon mesh, wherein the ribbons combine together in honeycomb-shaped cells, which ribbon mesh can be utilized on the face of an electrode core member.

Another mesh form for the mesh member 2, as has been more particularly discussed hereinbelow, can likewise use thin metal strips, or ribbons, and these can be brought together, such as to form honeycomb-shaped cells to thereby prepare the mesh member 2. Referring in this regard then to FIG. 8, a mesh as represented by such honeycomb-shaped cells is prepared by metal ribbons or strips 34 which are secured together at nodes 36 as by being welded together from the metal strips 34. The resulting mesh 2 has honeycomb-shaped voids 38. Preferably after assembly, the mesh 2 can be coated on the narrow front edges 39 around each honeycomb-shaped void 38.

Figure 9:
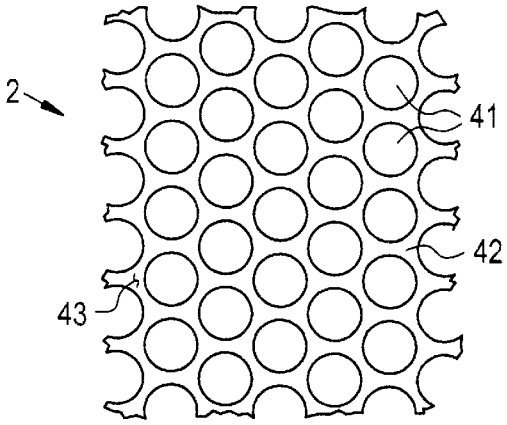
FIG. 9 is a plan view of a perforated plate mesh, which mesh can be employed on a face of an electrode core member such as the core member of FIG. 1.

As also discussed hereinbelow, a suitable mesh member 2 may be a perforate member such as prepared from a punched and/or drilled plate. In FIG. 9 a representative perforated plate mesh member 2 is depicted. This plate mesh member 2 has circular holes 41 such as might be provided by punching through a plate. Between adjacent circular holes 41 there is maintained an interconnected network of metal strands 42. These strands 42 provide a face area 43 for the perforate mesh member 2 which can be coated. Securing of the perforate plate mesh member 2 to a base 5 may be accomplished such as by spot welding or by employing fasteners, as is more particularly discussed hereinbelow.

In forming the compound electrode 1, there is first provided a lead base 5, serving as a support structure for the compound electrode 1, which lead base 5 has a broad surface, e.g., a front face 6. There is then provided a mesh member 2 that also has a broad surface or front face 10 as well as a broad back face 14, as in the representative compound electrode 1 such as shown in FIG. 1. The mesh member 2 is most always coated to provide an active front face 10, e.g., a front face 10 having an electrochemically active coating. When it is coated, in addition to coating of the front face 10, the mesh member 2 may have a coating on the back face 14 or the mesh member 2 overall may be coated. The mesh member 2 is combined with the lead support 5 in a manner whereby the mesh member back face 14, faces the broad surface, e.g., the front face 6, of the lead base 5. Then the mesh member 2 is secured to the lead base 5 in a manner providing electrically conductive engagement between the coated mesh member 2 and the lead base 5. Various means for providing such electrically conductive engagement will now be more specifically discussed hereinbelow.

For providing a compound electrode 1 such as depicted in the FIGS. 6 and 6A, a mesh member 2 in envelope form having a front member 2A and a back member 2B has a series of contact strips 16 secured to the back face 14 of both of the mesh members 2A, 2B. These front and back members 2A, 2B may be coated prior to having the contact strips 16 secured thereto. Contact strips 16 may also be secured to the inner face of any side edge sections 18 or bottom edge of the mesh member 2. The securing is all done to insure electrical contact between members, e.g., by electrical resistance welding. The mesh member 2 is then secured to the lead base 5, as by sliding the lead base 5 into this mesh member 2 of envelope form and compressing the front and back mesh members 2A, 2B inwardly against the lead base 5. Such compression can assist in insuring securing of the mesh member 2 to the lead base 5 in electrically conductive engagement. In general for any lead base 5, and including the base 5 of the FIGS. 6, 6A, the lead base 5 can be electrically connected to a power supply. This may be through a conductor bar 15. For example, the conductor bar 15 can be electrically connected to contacts (not shown) that connect with a power supply. The lead base 5 can serve as a current distributor member for the mesh member 2.

Another means for providing engagement of the mesh 2 and a base 5 can be understood by reference to FIG. 8. On assembly with a lead base 5, the honeycomb-shaped mesh 2 may be secured with the front face 6 of the base 5, as by pressing the mesh 2 into the base 5. In this procedure, the back edges around the honeycomb-shaped voids 38 may be pressed into the base 5. Although, as depicted in FIG. 8, the ribbons 34 have substantial width, it is to be understood that ribbons 34 of much lesser width may be utilized, e.g., on the order of one-quarter of the width of the ribbons 34 as depicted in the figure. Even for meshes 2 assembled from ribbons 34 of such diminished width, the resulting mesh may still be pressed firmly into a front face 6 of a base 5. Following such pressing operation, there may be exposed on the face 6 of the base 5 only essentially the coated edges 39 of the mesh 2.

Figure 10:
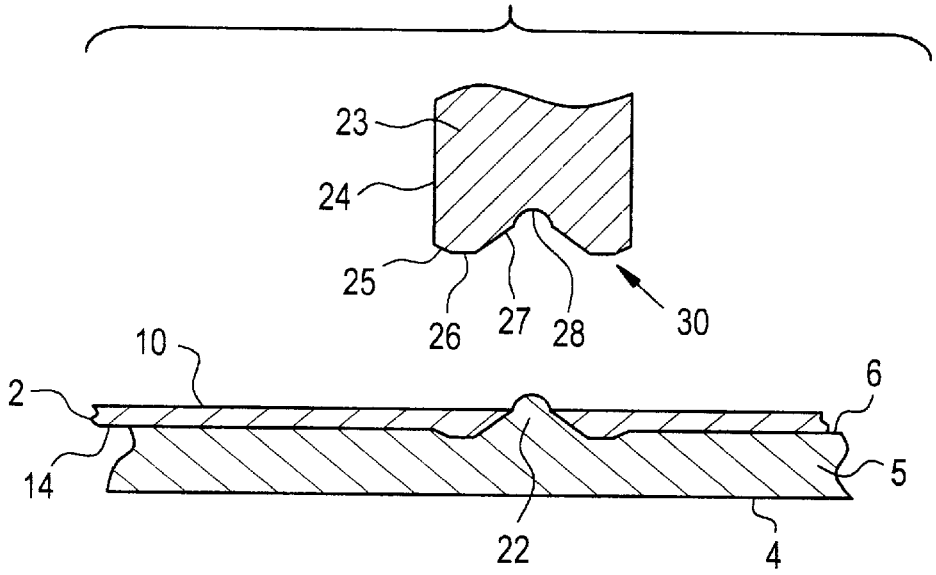
FIG. 10 is a section view of a compound electrode structure having a mesh secured by a weld nugget on a face of an electrode core member, which weld nugget is formed by a welding tip.
Figure 11:
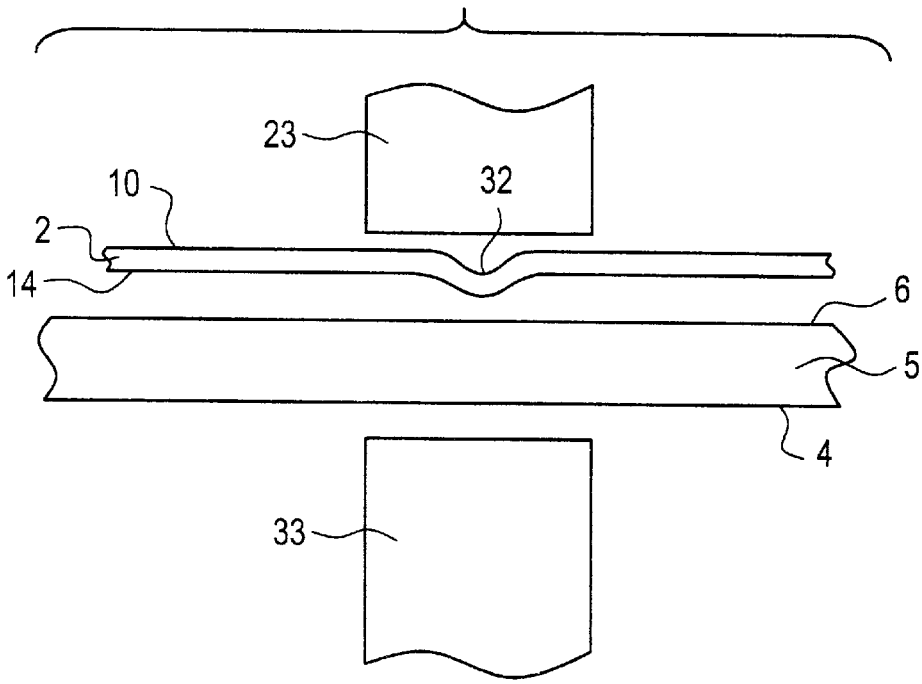
FIG. 11 is a section view of a dimpled mesh spaced from a face of an electrode core member with welding tips positioned above and below the mesh at the dimple.

Often welding is used as a means for providing engagement of a mesh 2 to a base 5, as has been shown hereinbefore in the figures. Further in this regard, reference can be made to the representative welding applications that are depicted in FIGS. 10 and 11. In FIG. 10, there is depicted a lead base 5 having a front face 6 and back face 4. On the front face 6 is a mesh member 2. The back face 14 of this mesh member 2 engages the front face 6 of the base 5 and is secured to the lead base 5 by means of a molded lead weld nugget 22 formed during the welding. The metal of the lead base 5 encapsulates the mesh member 2 at the formed nugget 22 providing a secure mechanical joint as well as desirable electrical contact between the lead base 5 and the mesh member 2. The nugget 22 is provided by resistance welding equipment that includes a first welding tip 23. The welding tip 23 is typically circular in cross section, thereby typically providing a weld nugget 22 that appears circular when looking down upon the front face 10 of the mesh 2. At the front face 30 of the welding tip 23, the tip of the outer surface 24 initially extends inwardly to form a downwardly angled surface 25. This downwardly angled surface 25 terminates in an at least substantially flat front surface 26, which is usually a short front surface 26, of the welding tip 23. There then extends beyond the flat front surface 26, in a direction toward the center of the welding tip 23, an upwardly angled surface 27 leading to a central, recessed dimple 28.

On applying the welding tip 23, in combination with the application of a facing, or second, welding tip 33 (FIG. 11) applied to the back face 4 of the base 5, the welding current provides for localized melting of the lead metal of the base 5. The pressure from the welding tip 23, combined with the contour of the front face 30 of the tip 23, forces the molten lead toward the center of the tip 23 and up and over the mesh member 2. This provides the molded lead weld nugget 22. This nugget 22, in cross section above the mesh 2, can be identical to the cross section of the area below the angled surface 27 and recessed dimple 28.

Referring then to FIG. 11, a lead base 5 has a front face 6 and back face 4. The mesh member 2 also has a front face 10 and a back face 14. Into the mesh member 2 there has been applied a dimple 32, such as might be obtained by hammering a ball bearing into the mesh 2 and then removing the ball bearing. Above the mesh member 2 at the dimple 32 is a first welding tip 23. Below the back face 4 of the lead base 5 is a second welding tip 33.

For fastening the mesh member 2 to the lead base 5, the second welding tip 33 is brought up into contact with the back face 4 of the lead base 5 while the first welding tip 23 is brought downwardly into contact with the front face 10 of the mesh 2. Then the gap is closed between the mesh 2 and the base 5 so that the dimple 32 is in contact with the upper face 6 of the base 5. When welding current and pressure are concentrated at the center of the dimple 32, the dimple 32 of the mesh 2 can penetrate into the front face 6 of the melting lead base 5, and the mesh 2 can be sufficiently pressed down for the back face 14 of the mesh 2 to engage the front face 6 of the base 5. Molten base metal pooling within the dimple 32 forms a strong bond, as well as electrical contact, between the mesh 2 and the lead base 5.

Figure 12:
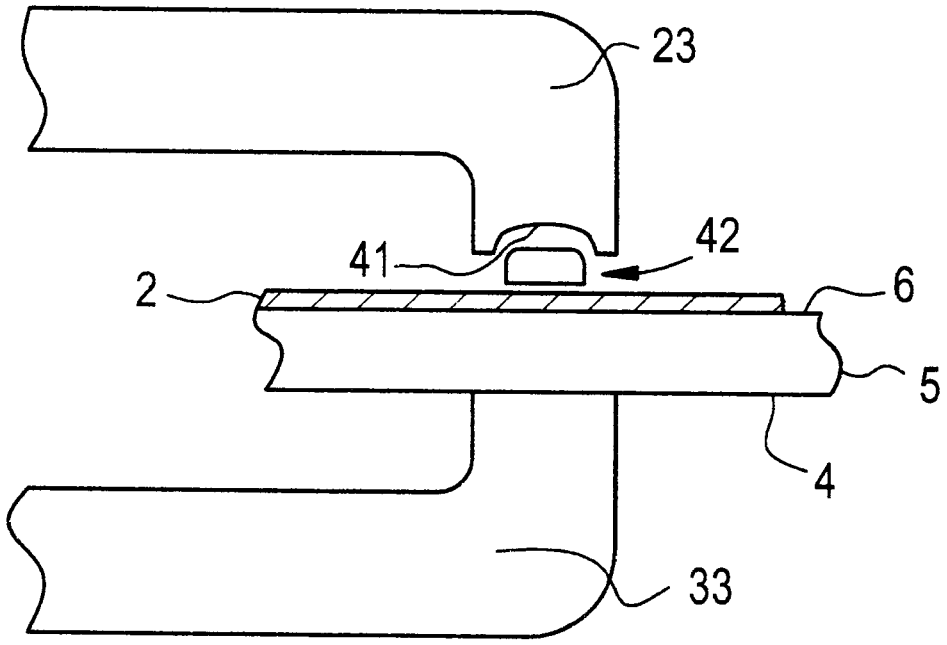
FIG. 12 is a plan view of a compound electrode structure shown in cross section and positioned between welding tips preloaded with weld metal.

Referring then to FIG. 12, a lead base 5 has a front face 6 and back face 4. On the front face 6 is a mesh member 2. The back face 14 (FIG. 11) of this mesh member 2 engages the front face 6 of the base 5. Above the mesh member 2 is a first welding tip 23. Below the back face 4 of the lead base 5 is a second welding tip 33. The first welding tip 23, at the tip, has a recessed dimple 41. The welding tip 23 is preloaded with a metal weld nugget 42, e.g., a fresh nugget of lead or lead alloy.

On applying the welding tip 23, in combination with the second welding tip 33 applied to the back face 4 of the base 5, the welding current provides for melting of the metal weld nugget 42. The pressure from the welding tip 23 forces the molten metal of the metal weld nugget 42 into a molded lead weld nugget. The resulting molded lead weld nugget secures the mesh member 2 to the base 5 in a strong, electrically conductive bond. The resulting nugget can be achieved without providing weld material to the nugget from the lead base 5. Where a mesh member 6 will also be applied to the back face 4 of the lead base 5, a second weld nugget (not shown) can be utilized with the second welding tip 23 and such welding tip may be contoured in the manner of the first welding tip 23.

Figure 13:
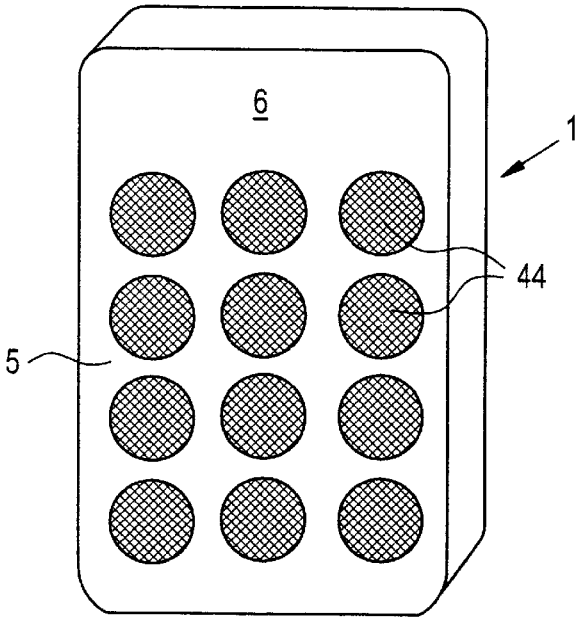
FIG. 13 is a perspective view of a compound electrode structure having small mesh members on the front face of an electrode core member.
Figure 13A:
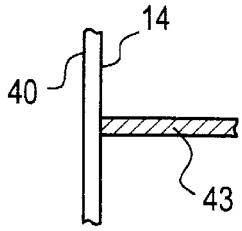
FIG. 13A is a side view of a small mesh member suitable for use in the compound electrode of FIG. 13.

Another means for providing engagement of a mesh 2 on a base 5 can be understood by reference to FIGS. 13 and 13A. By reference to these figures, a compound electrode 1 has a lead base 5. On the front face 6 of the lead base 5, there are secured a multitude of small mesh members 44. These small mesh members 44 are comprised of a forward, typically flat, mesh head 40, and behind the head 40 is a securing member 43, e.g., a fastening stud. The securing member or stud 43 can be secured to the mesh head 40 as by welding. On assembly of the compound electrode 1, the stud 43 is forcibly pressed into the lead base 5. This would typically be pursued until the back face 14 of the mesh head 40 is pressed against the front face 6 of the lead base 5.

Although the mesh head 40 as depicted in FIG. 13 is circular and forms a mesh disc, it is understood that other shapes, e.g., oval, square, rectangular or the like, would be useful. Although the members 40 are depicted in FIG. 13 as being placed in a pattern, they could be placed randomly. Also, although as shown in FIG. 13 the mesh members 44 are spaced apart one from the other, they could be contiguous, one with the other, or even overlap. In this regard, small mesh members 44, particularly those which are rectangular or square and are placed in a contiguous or overlapping manner, can form a grid on the front face 6 of the lead base, such as in the manner of the grid of FIG. 7 as will be more particularly discussed hereinbelow.

Figure 14:
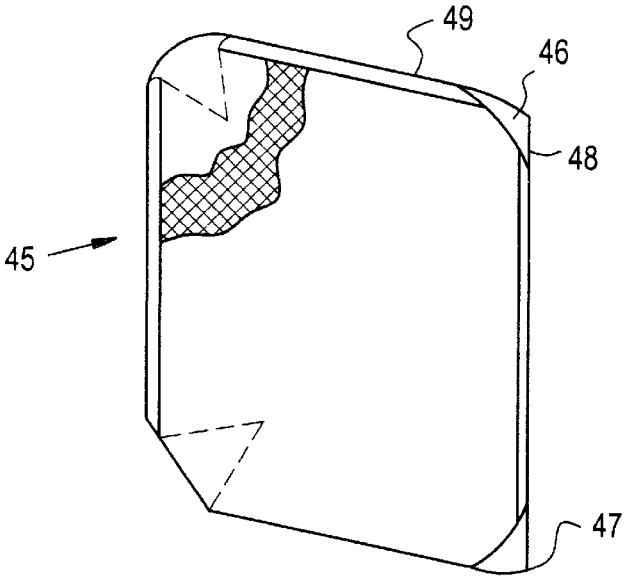
FIG. 14 is a perspective view of a mesh member that can be utilized for making a compound electrode of the present invention.

Yet another means for providing engagement of a mesh 2 with a base 5 is depicted in FIG. 14. As depicted in this figure, a mesh plate 45, which may sometimes also be referred to herein as a mesh cleat 45, has plate corners 46 that are bent away from the general plane of the mesh plate 45. These plate corners 46 can have sharp points 47 and edges 48. For the construction of the plate 45 itself, such may have mesh or solid edges 49 and can have solid plate corners 46. The mesh plate 45 can be secured to a lead base 5 by pressing the plate corners 46 into a lead base 5. Such pressing can continue until the back face of the mesh plate 45 is pressed against the front face 6 of a lead base 5. As for the small mesh members 44 of FIG. 31A, the mesh plate 45 can have a multitude of shapes, e.g., circular, oval, square or rectangular and the like.

It is contemplated that the mesh plate 45 may be of sufficient size as to duplicate the size of the mesh member 2 of the compound electrode 1 of FIG. 1. When of such size, the mesh plate 45 will itself cover the front face 6 of the lead base 5. Alternatively, other configurations are contemplated. For example, the mesh plate 45 may be sized in accordance with the small mesh members 44 of FIG. 13. Thus, a great multitude of the mesh plates 45 may be utilized in covering a front face 6 of a lead base 5. Furthermore, in addition to having plate corners formed for pressing into a lead base 5, the mesh plate 45 may have one or more securing members, such as the studs 43 for the small mesh members 44 of FIG. 13. Moreover, particularly as small mesh plates 45, these plates 45 may be secured to, and arranged on, a lead base 5 in a manner of a grid such as depicted in FIG. 7. Thus, mesh plates 45 can be placed in a manner contiguous with one another or even overlapping one another so as to form a grid pattern on a lead base 5. Furthermore, the mesh plates 45 can be placed on a lead base 5, in a manner contiguous or overlapping, so as to at least substantially completely cover a front face 6 of a lead base 5.

As has been shown hereinabove in the figures, generally the mesh member 2 need not cover an entire broad surface 6 of the lead base 5. Exposed areas for the front face 6 of the lead base 5 can include an exposed facial edge 20 of the mesh 2. The exposed edge 20 can include both top and bottom edges, as well as side edges, all of which are depicted in FIG. 1. Also, as shown in FIG. 2, an exposed area for the base 5 may exist only at the top and bottom edges of the front face 6. The mesh member 2 may extend edge-to-edge on the front face 6 of the lead base 5, i.e., the front face 10 of the mesh 2 can be at least as large as the front face 6 of the base 5. This edge-to-edge extension may cover top-to-bottom, but will more typically cover side-to-side on the front face 6, as has been shown in FIG. 2. Regardless of considerations of edge area, the front face 6 of the lead base 5 will be exposed at the voids 7 of the mesh. For example, in FIG. 1, the voids 7 of the fine mesh 2, basis the area of the front face 6 covered by the mesh 2, will leave from about 60 to about 65 percent or more of the lead base 5 surface area exposed by the voids.

In FIG. 2, this exposed surface area of lead base 5 provided by the voids 7, or mesh "void fraction" or mesh "open area" as such terms are used herein, is on the order of about 80 to 85 percent exposure. For the meshes of FIGS. 3 and 4, this percentage exposure is on the order of about 55 percent and 90 percent, respectively. Thus, although it has been mentioned hereinbefore that open area of the mesh might range from 5 to 90 percent, it can be appreciated that the mesh may most often leave exposed from about 50 percent to about 90 percent or more of the lead base 5 covered by the mesh 2. When the top of the lead base 5, as well as its edges are considered, e.g., the edge surface 20 of the plate-shaped lead base 5 (FIG. 1), these exposed areas plus the void area of the mesh 2 may total upwards of as much as on the order of greater than 90 percent exposure for the total area of a front face 6, even for a mesh providing only about a 50 percent void fraction. Nevertheless, it has been found that the compound electrodes 1 may be serviceably operated with virtually no soluble lead becoming present in the electrolyte even under electrolyte conditions containing strong inorganic acids, e.g., copper electrowinning utilizing sulfate electrolyte containing sulfuric acid.

It will be appreciated that in addition to the mesh member 2 going edge-to-edge, from either top-to-bottom or side-to-side edges, or both, which will be done by typically using a mesh sheet, that it is also contemplated that the lead base 5 may be wrapped with the mesh member 2, as with a mesh member 2 in strip form. This can be a total wrapping to include both front and back faces 6, 4 of the lead base 5 as well as all edge surfaces 19 for the lead base 5. In this regard, a wrap of a mesh member 2 around a base 5 for preparing an electrode has been disclosed in International Application WO 96/34996. Also, any lesser combination, i.e., less than total wrapping, of front and back faces 6, 4 and the edge surfaces 19, is contemplated. In wrapping, one layer, or multiple layers of the mesh member 2 could be used to wrap around the base 5. Also, when applied only to portions of the lead base 5, e.g., the front and back major faces 6, 4 of the lead base 5, the mesh member 2 may be applied in multiple layers, such as a stack of many individual layers.

Where the mesh member 2 does not extend edge-to-edge, either top-to-bottom or side-to-side, it is contemplated that the otherwise exposed facial edge 20, as well as the edge surfaces 19 for a plate-shaped base 5, could be covered. A covering, such as with a covering member in strip form, may then provide that the total front face 6 of the lead base 5 has either an applied mesh member 2, or edge strips. Where the edge strips are on all of the facial edge surfaces 20 of a front face 6 or the like, such edge strips can form a frame. This could be a four-edge strip, as for a rectangular or square base 5, or a single-edge strip, as for an oval or circular base 5, and so on. The area within the frame can be taken up by the mesh member 2. Where such edge members are contemplated, they will typically be electrically nonconductive, e.g., formed from a material such as a polymeric material. Suitable polymeric materials can include polypropylene, polytetrafluoroethylene (PTFE), polyethylene, polyvinylidene fluoride, e.g., Kynar™ polyvinylidene fluoride, polyvinyl chloride (PVC) or chlorinated polyvinyl (CPVC). Where wrapping of the lead base 5 is contemplated with the mesh member 2, it is preferred that the mesh member 2 not extend over any edge strips. In the preferred manner, the whole mesh member 2 contacts the lead base 5.

It has been discussed hereinbefore that the lead base 5 can be typically plate-shaped as well as have a substantially rectangular shape, all of which have been depicted in the figures. However, other shapes for the lead base 5 are contemplated. For example, the lead base 5 may take the form of a radial electrode and have substantially curved front and back faces 6, 4. Such curved lead base faces have been shown, for example, in International Application WO 97/06291. One or both of the front and back faces 6, 4 may have a mesh member 2. Or the lead base 5 may be cylindrically shaped, with a mesh member 2 on one or both of the inside diameter major face and outside diameter major face.

Where the lead base 5 is a new lead base, it can have a freshly prepared front face 6, where usually no further operation is involved before securing of the mesh member 2 to the lead base 5. Where the lead base 5 has been previously utilized, at least the front face 6 may be refurbished, or "prepared", to provide a fresh lead face 6. Such preparation may be by one or more of a mechanical operation such as machining, grinding and blasting, including one or more of sand, grit, and water blasting. There can also be utilized sanding and buffing. Preparation may also include a chemical procedure such as etching or current reversal. Such operations can form a suitably prepared surface for securing the mesh member 2 thereto.

Generally, the low operating potential of the mesh member 2 during operation of an electrolytic cell will inhibit corrosion of the lead base 5. Also, if desired, in addition to the front face 10 of the mesh member 2 being coated, the back face 14 of the mesh may also be coated. This can be intentional, or it may naturally occur at least as a partial coating by wrap-around effect during coating of the front face 10. In either case, this may serve to retard or prevent any interface corrosion between the lead base 5 and the mesh member 2. Such a coating might be an electrochemically active coating as discussed hereinbelow.

Although it is contemplated that the entire mesh member 2 will virtually always directly contact an otherwise unprotected surface of the lead base 5, where concern may nevertheless still exist for corrosion of the lead base 5 under cell conditions, the lead base 5 itself may be coated. Such a coating can take many forms and can be generally applied by any manner for applying a coating substance to a metal substrate. For example, a protective coating can be applied in sheet form to the entire front face 6 of the lead base 5. Such sheet form protection might be a nonconductive polymeric sheet. The protective coating can be in polymeric form, e.g., an epoxy resin, and applied in any of the variety of techniques used for applying a polymeric material to a substrate, such as a plasma spray applied PTFE coating. The coating might further be exemplified by a wax, including paraffin. Ceramic coatings could also be useful and these might be spray applied. Or the protective coating might be provided by a curable liquid that is applied, and cured on, the lead base 5. This can be useful in protecting any portion of the lead base 5 that is of concern for corrosion. The liquid applied might be a paint such as of a bituminous material or of similar composition, e.g., a lacquer or varnish. Such could be applied by any conventional application such as spray coating, roller coating, dip coating, brush coating and the like. Where the protective coating is a sheet form polymeric film, all or a part of the lead base 5 might be enveloped in a shrink-wrap polymeric film. Where a coating is utilized, it will be understood that the portion of the lead base 5 left exposed by mesh member voids can, therefore, expose a coated lead base 5.

Once the area of concern of the lead base 5 is protected, where the mesh member 2 is to be overlaid, it can engage the coating. For some mesh members 2, such as the honeycomb shaped mesh 2 of FIG. 8, or an expanded metal mesh in unflattened form, the mesh may simply penetrate through the coating, e.g., be passed through the coating, such that the entire mesh contacts the lead base 5. Otherwise, or in addition, electrical contact can be made between the mesh member 2 and the underlying lead base 5, advantageously by fasteners such as staples, brads, rivets, screws, bolts, spikes and the like. These can penetrate through the protective coating to the lead base 5, but may have a sealing material applied at the area of penetration so as to maintain the integrity of the protection of the lead base 5.

The mesh member 2, as noted hereinbefore, in addition to being prepared by an expansion of a metal sheet, may be prepared in wire form, e.g., a woven wire mesh 2 that might be an open mesh sheet in the form of a screen. The wire mesh 2 may be preformed as such woven wire mesh and applied to the base 5. Alternatively, the wire form mesh 2 might be formed from individual wires, e.g., wires which are individually applied onto the base 5 as in a cross-hatch pattern to form the mesh 2.

As has also been mentioned hereinabove, the mesh member 2, in addition to being prepared from a metal expander, may be useful in unflattened form. If it is desired to have the mesh in unflattened form yet provide a large flat front face for the mesh, then a mesh of FIG. 3 can be particularly suitable. It is contemplated that any mesh member 2, prepared such as by metal expansion, can be useful in both unflattened as well as flattened form. In unflattened form, the mesh 2 may be especially serviceable for pressing into the lead base 5. For example, the mesh of FIG. 4, which is depicted in unflattened form, has nodes 9 which are essentially completely vertical in positioning, when considered in reference to the horizontal front face 6 of the lead base 5. Upon pressing of this mesh member 2 into the lead base 5, these vertically oriented nodes 9 will provide ease of penetration into the lead base 5. Where a mesh member 2, such as is shown in FIG. 4, is desired to have an enlarged front face for the mesh member 2, and where securing of the mesh member 2 to the lead base 5 might be by means such as small fasteners, then this mesh member 2 can be flattened, thereby changing the orientation of the nodes 9 more toward the horizontal plane of the front face 6 of the lead base 5.

Alternatives to expanded metal meshes have been discussed hereinabove and shown in the figures. Thus, "mesh member" is a term used herein for convenience. Other mesh member forms that have been previously depicted include those made from thin, generally flat members in strip form, which may also be called ribbon form. The strips can be spaced apart, as a multitude of closely spaced solid or perforate strips positioned such as in parallel form to one another. For example, a multitude of solid strips of coated titanium might be secured in a parallel array on a face of the base 5, with the strips spaced apart one from the other, but usually not widely spaced apart from one another, e.g., usually close enough to be at least substantially adjacent one another. Or, as shown in FIG. 7, thin, flat strips can also be spaced to provide contact at nodes where strips are placed in grid form. The grid form mesh can be preformed, or may be formed on the base 5 as the individual strips are applied. Strips in the grid form that are parallel to one another may be spaced apart without being substantially adjacent one another. The strips could have fasteners, e.g., studs, at the back of the strips to be pressed into the base 5 to affix the strips to the base 5 in the manner of the studs 43 for the mesh members 41 in FIG. 13.

Other mesh member forms include those wherein thin metal ribbons may be corrugated and individual cells, such as the honeycomb shape cells as shown in FIG. 8, can be welded together from the ribbons. Slitters or corrugating apparatus could be useful in preparing metal ribbons and automatic resistance welding could be utilized to prepare the resulting mesh. Still further perforate metal forms for the mesh members include punched and/or drilled plates, of the type as depicted in FIG. 9, as well as chain link or linked ring structures. For some members, e.g., punched plates, the punching could leave louvers angled from the face of the plate, and these may serve in the manner of barbs, which louvers could be embedded in the lead base 5. It is also contemplated that rods or blades may form a useful mesh, e.g., coated rods or blades could be pressed into the lead base 5 as in parallel form, or a grid form, such as a lattice. In general, pressing can include hot pressing, and this might be pressing with a heated plate. The pressing can be in addition to utilizing other fastening means, e.g., welding.

Pressing can also include hammering or the like, as with a pneumatic hammer. The hammer tip may have the shape of a washer. The tip can be utilized to impress mesh 2, e.g., at the nodes 9, into the base 5. Where the mesh 2 is indented into the base 5, the tip can form a washer-shaped indent in the base 5. Typically, employing a pneumatic hammer for fastening mesh 2 to the base 5 can result in pulling the mesh 2 very taut across the face 6 of the base 5 for desirable engagement of the back face 14 of the mesh 2 with the face 6 of the base 5. Also, the mesh 2 may be secured to the base 5 by a multitude of fasteners. These can include brads, staples, split nails, rivets, studs, screws, bolts, spikes and the like, some of which have been mentioned hereinbefore. Some fasteners, such as those that are spikes or the like, e.g., split nails or rods, and including those that could be press fit into holes in the base 5, may have enlarged heads which could be flattened to provide expanded contact with the mesh 2. Furthermore, the heads could have knurls or splines to further enhance contact with the mesh 2. Moreover, the mesh 2 might be welded to the head of the fastener as in the manner of welding the mesh 2 to the split nail 12 in FIG. 5.

Where an article of this type is used, the mesh 2 might be preapplied to the fastener. The preapplied mesh might only be a segment of mesh, e.g., a mesh member 41 in FIG. 13, and, when the segment is preapplied to a fastener, this can form a unit. Then the unit can be attached by means of the fastener to the base 5. Thus, a segment of mesh 2 approximately of a size, for example, of the piece of mesh 2 depicted in FIG. 8, could be pre-secured, as by welding, to a fastener such as the split nail 12 of FIG. 8 to form a unit. Then this resulting mesh segment could be fastened to the base 5. In this manner, the mesh 2 may be applied to the base as a pattern of segments, e.g., a pattern of squares of mesh or the like as has been discussed hereinabove in connection with FIG. 13. The individual mesh shapes, e.g., squares or discs, can be placed adjacent one another, or overlapping or spaced apart from one another. In placement, the discrete units might assume a regular or a random orientation. Other such mesh units, e.g., having mesh discs, or "heads" with a projecting stud fastener, are contemplated. Furthermore, these units could include other shapes such as squares and have solid, typically flat heads, providing units that in appearance can resemble thumb tacks, and which are placed on the base 5 adjacent one another. Such units, typically as small units, can be placed so as to provide an arrangement as depicted in FIG. 7, while obviating the overlapping joints of FIG. 7. Each unit making up the FIG. 7 arrangement can have a fastener such as a stud backing to press into the base.

Materials of construction, such as for the brads, or other fastening means, e.g., countersunk bolts, need not be conductive if there is otherwise desirable contact for electrical connection maintained between the mesh 2 and the base 5, e.g., the back face 14 of the mesh 2 itself so engages the base 5. Hence, brads of a polymeric material such as polypropylene, polyethylene, PTFE, PVC or CPVC may be serviceable. Where the fasteners are conductive, they are most suitably conductive metallic fasteners for economy. Advantageously, for conductivity as well as resistance to cell conditions, they are valve metal fasteners such as titanium, tantalum, zirconium, niobium, and tungsten fasteners. A preferred valve metal is titanium. Particularly where the fasteners are metallic fasteners, the fasteners may be coated, as with an electrochemically active coating as described hereinbelow. The louvers 16, between a mesh member 2 and base 5 can be a flat form spring, which may be stamped out with multiple fingers or louvers 16. These louvers 16 can have a sharp edge electrical contact with the lead base 5 as well as with the mesh member 2. A well-known louver of this type is a torsional louver type band, generally in strip form, utilized as an electrical interface.

Where the metal-to-metal bonding means for bonding the mesh 2 to the lead base 5 is welding, such can include TIG or resistance welding, laser welding or capacitance discharge welding. Although welding traditionally involves the heating of two metals until they become molten, it will be understood that as the word "welding" is used herein it will virtually always refer to the heating, until molten, only of the lead. Thus where lead is melted and fused to a titanium mesh, such may be accomplished with welding equipment and be referred to herein as welding even though the mesh member metal, e.g., titanium metal, does not become molten. Where molten lead from the base 5 is around the mesh 2 or over the mesh 2, as depicted in FIG. 10 wherein welding has been used, reference may be made herein to the mesh 2 being "molded" to the base 5. In addition to providing a weld nugget 22 in a shape as depicted in FIG. 10, nuggets of other shapes can be serviceable. For example, the front face 30 of the weld tip 23 may be simply angled inwardly, so as to provide a pyramid-shaped weld nugget 22. It is contemplated that other means that can be useful for bonding metals, e.g., soldering or brazing, may also be utilized. Thus, the bonding can take a form of being "in" the lead, e.g., brads, or "on" the lead, e.g., welding or pressing, or "through" the lead, such as holes drilled through the lead for studs or the like to penetrate through.

The mesh member 2, e.g., as a coated valve metal mesh 2 or a platinum group metal mesh 2, can provide a stable mesh member 2 for the compound electrode 1. The mesh member 2 can be capable of resisting deleterious corrosive action in an electrolytic cell and provide a more inert compound electrode 1 under cell operating conditions, than for just the lead base 5 alone.

Where valve metals are used for the mesh 2, they may become oxidized on their surfaces increasing the resistance of the valve metal to the passage of current, thereby passivating the mesh member 2. Therefore, for the active front faces 10 of the mesh members 2, it is customary to apply electrically conductive electrocatalytic coatings so that they then do not become passivated. In the coating procedure, it will be understood that even when coating only the front face 10 of the mesh member 2, there may be some wrap around of the coating, even to the back face 14 of the mesh 2, which wrap around might result in covering the entire surface of the mesh 2. Alternatively, it may be desired to coat all surfaces of the mesh 2, or to coat just the front and back faces 10, 14.

The mesh members 2 are usually coated before they are installed on the lead base 5. However, it is contemplated that they may be coated after installation, or that a combination of coating before and after installation could be used. Before final coating, the mesh member 2 may receive one or more prior coatings, as on a front face 10. For example, the mesh member 2 can have applied a thermally spray applied undercoating, e.g., a plasma spray coating, such as of a metal, which metal could include titanium, or a metal oxide, which could include titanium oxide. The coating can be useful for providing an enhanced surface, as exemplified by a greater surface area, for receiving a top coating. As representative of the electrochemically active coatings that may be applied, usually as the only coating, but which may serve as a top coating, are those provided from platinum or other platinum group metals, e.g., providing a mesh member such as of platinized titanium or platinized niobium. Or the active coatings can be represented by active oxide coatings such as platinum group metal oxides, magnetite, ferrite, cobalt oxide spinel, lead dioxide, manganese dioxide or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526; 3,632,498; 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those enumerated above include manganese dioxide, lead dioxide, platinate coatings such as $M_xPt_3O_4$ where M is an alkali metal and x is typically targeted at approximately 0.5, nickel-nickel oxide and nickel plus lanthanide oxides.

It is contemplated that the face area of the mesh member 2 can be partially coated, or can be coated with different coatings at different parts of the face. For example, the mesh member 2 of FIG. 1 can have differing coatings on lower and upper areas of the front face 10 of the mesh 2 to provide a bipolar electrode. This may also be achieved by coating one area of the front face 10 while leaving an adjacent area of the face 10 uncoated. A bipolar electrode of this type has been disclosed in U.S. Pat. No. 4,783,246. It is also contemplated to provide a bipolar electrode, such as by having mesh members 2 on the front and back faces 6, 4 of the lead base 5. These mesh members 2 may then have different coatings, or one may be coated and the other uncoated. Also, the mesh members 2 on the front and back faces 6, 4 can be the same or different. For example, the mesh member 2 of FIG. 1 may be secured on the front face 6 of the lead base 5, but a different mesh member 2, e.g., the mesh 2 of FIG. 3, can be on the back face 4 of the lead base 5. Or a stack of multiple layers of mesh can be secured on the front face 6 of the lead base 5, but a single layer of mesh can be affixed on the back face 4. These arrangements can be desirable for providing a greater surface area on one side of an electrode that can serve as a bipolar electrode.

As has been discussed hereinbefore, the compound electrode 1 is particularly serviceable as an anode in a copper electrowinning cell. However, these electrolytic cells can also be used for other electrodeposition processes such as plating, e.g., the electroplating of metals such as zinc, copper, cadmium, chromium, nickel, and tin, as well as metal alloys such as nickel-zinc, onto a substrate. Such plating can include copper foil production. The substrate may be a moving substrate and the electrodeposition in such process can include electrogalvanizing or electrotinning. A cell utilizing the present invention can be utilized in the oxidation/reduction of an ionic species, such as oxidation of ferrous ion to ferric ion, chloride to chlorine, iodide to iodine, bromide to bromine, or cerous ion to ceric ion, or in the oxidation or reduction of an organic species, including utilization in organic destruction. A cell employing the present invention may also be used in non-electrowinning, or non-electroplating processes such as electromachining, electrofinishing, electrophoretic painting, anodizing, electrophoresis, and electropickling. A cell using the present invention can be a cell where a gap is maintained between electrodes, and cell electrolyte is contained within the gap. The electrolyte might typically be a sulfur-containing electrolyte such as sulfuric acid or copper sulfate, but the use of other electrolytes, e.g., chloride based electrolytes and nitrite-containing electrolytes, is contemplated. It is further contemplated that cells using the present invention may also be separated cells, i.e., the cells may be diaphragm or membrane cells.

Although the compound electrode 1 will most always find service as an anode, such should not be construed as a limitation. For example, the electrode may serve as a cathode, such as in a cell used for the reduction of ferric ion to ferrous ion, or in a cell used for hydrogen generation. Uncoated metal mesh members, e.g., platinum and platinum group metal mesh members, might serve as cathodes, for example in an application involving hydrogen generation. But such uncoated metals for cathode mesh members could also include nickel, iron, aluminum and alloys and intermetallic mixtures of same. A nickel cathode might be employed in alkaline environments.

The following examples show ways in which the invention has been practiced, but should not be construed as limiting the invention.

EXAMPLE 1

Expanded, unflattened titanium mesh of grade 1 titanium was selected for covering the front and back major faces of commercial lead anodes. The lead anodes were configured in essentially sheet form with the sheets being ¼ inch in thickness. Each front and back major face for the lead anode sheet measured 36½ in. wide×37 in. high. Each commercial anode weighed approximately 200 pounds. The titanium mesh test sheets were sized to, in large part, cover each front and back major face of the lead anode, extending fully from edge to edge across the width of each face, as well as extending from the bottom edge of each face to about one inch above the reach that would be achieved by the electrolyte when the anode was installed in the commercial cell, i.e., the liquid-air interface. Also, about 3 inches of the top of each face of the lead anode was left exposed above the upper reach of the mesh. Moreover, the side edges of all lead anodes were left exposed and the bottom edge for most lead anodes was left exposed, as more fully discussed hereinbelow.

Several of the titanium mesh test sheets that were used were expanded titanium metal test sheets having LWD and SWD diagonals of the diamond-shaped apertures measuring 1.2 in. and 0.5 in., respectively. These were placed on the front and back major faces of lead anodes. In addition to these "first mesh" sheets, another titanium mesh selected for test was the FIG. 1 fine mesh described more particularly hereinbelow in connection with Example 2 ("second mesh"). This fine mesh was wrapped on the mesh from one major face, across the lead base bottom edge, then up the other major face. Several of these anodes utilized two layers of the mesh while the balance had a single layer. This wrap extended about an inch above the liquid-air interface on each major face. The base side edges were left exposed. The voids of the mesh itself left exposed about 65 percent of the lead face area covered by the mesh. The other mesh selected for the test was the mesh depicted in FIG. 3 ("third mesh"). It left exposed about 55 percent of each lead face covered by the mesh.

The meshes were prepared in the manner as described hereinbelow in Example 3, i.e., etching followed by coating. After each coating, the test meshes were air dried and baked. The coatings were applied to the entire front face of each titanium test mesh, but no procedure was used to prevent wrap around of the coating to the mesh back face. Coating solutions were applied and baked in the manner as described in Example 3. Coatings were from a solution of ruthenium chloride and titanium orthobutyl titanate in HCl and n-butanol (the "ruthenium coating"), as well as from iridium chloride and tantalum chloride in aqueous HCl (the "iridium/tantalum coating").

The front and back faces of the commercial lead anodes were then covered as described hereinbefore with the mesh sheets. One sheet of mesh was used for each major face of the lead anode, excepting for the fine mesh where two layers of this mesh were used on each anode face. Both the front and back faces of each anode were covered. For each of these test anodes, the same mesh, with the same coating, was used front and back. Of the 55 test anodes for the commercial test cell, there were 22 anodes having the ruthenium coating on the mesh, and 23 anodes having the iridium/tantalum coating on the mesh. Some of the anodes having the ruthenium coating had this coating as a topcoat over an iridium coating as described hereinbelow in Example 3. Each coating was used on about one-third of the test anodes to provide about an even mix for the coatings among the anodes. Furthermore, there was utilized 13 anodes using the first, 22 using the second and 20 anodes using the third mesh. The meshes were secured to the faces of the lead anodes by various procedures including spot welding and mechanical attachment. The coated faces of the mesh faced outward for each anode.

The 55 test anodes thus prepared were then placed in a single cell of a commercial cell room. The product of the cell room was commercially electrodeposited copper and the room contained a great multitude of cells, including the one test cell and a balance of conventional cells. The electrolyte circulating through all of the cells during the about three months of the test, contained from about 140 to about 160 g/l sulfuric acid, with a concentration of from about 40 to about 50 g/l of copper. Also during the about three month test, the current density in the cell room varied from about 18 to about 26 amperes per square foot (ASF). During cell operation, each test anode was immersed in the electrolyte such that a small portion of mesh at the top of the anode was present above the surface of the electrolyte. During cell operation, copper plated on stainless steel cathodes. The cathodes were flat plate cathodes having front and back major faces of the same size as for the anodes. The copper plated on both sides of the cathode. There was an anode placed at each cell end. The cathodes and anodes were arranged face to face in the test cell. For installation of the 55 anodes in the test cell, no modification of the cell assembly or of any other feature of the cell room operation, e.g., electrolyte type or substituent concentration, or of the cell current density, was necessitated.

During the about five months of cell room operation, the anodes and cathodes from the test cell were pulled about every seven days. This was done to provide for electrode and cell inspection. Each time cathodes were pulled, the copper deposit on the pulled cathodes could be seen by visual inspection to be a smooth, uniform deposit on virtually all cathode faces. On a few cathode faces, the continuously smooth deposit was interrupted by a nodule. However, no cathodes were observed to have dendritic growths. Thus, the copper deposits for the test cell were concluded to be desirably uniformly plated when compared with the cathodes for the other cells of the cell room, since all of these other cathodes not only had frequent nodules but also exhibited dendritic growths. Moreover, on analysis of the copper deposit, lead impurity was found to be, on average, at over a ten-fold decrease from the average lead impurity level in the copper obtained in the other commercial cells in the cell room.

The cell room was operated in usual manner such that the non-test, conventional cells were regularly taken out of service. During this servicing, there would be removed from the bottom of each conventional cell from about 80 pounds to about 100 pounds of sludge, which was essentially lead oxide with lead sulfate. Comparatively, in the about five month cell room operation, there was never any sludge development in the test cell.

There was also observed during the usual four week rotation of the conventional cells, that the lead anodes when pulled from the electrolyte, exhibited a noticeable lead oxide coating. Generally, flakes of the coating could be manually easily brushed from the exterior surfaces of the lead anodes.

On removal of the test cell anodes, no similar loose oxide coating could be found on any exposed lead surfaces. Even on the unmeshed edges of the test anodes, no surface coating from these lead edges could be easily manually removed. Furthermore, on manual application and removal of pressure sensitive tape to these exposed lead edges, the tape failed to lift any surface material from the anode edges. This highly desirable surface feature prevailed for the entire duration of the test. Moreover, for all of the test anodes, no corrosion or pitting could be found on the lead at the liquid-air interface, indicating that the test mesh was serving to stabilize that interface.

During the approximately five months of cell room operation, no short circuit occurred in the test cell owing to any dendrite formation and growth. Furthermore, voltage savings for the test cell were found to range from about 100 mV up to about 300 mV. On one test anode, during cell shutdown and pulling of electrodes from the test cell, a portion of a mesh electrode became separated from the lead anode base. This torn portion of mesh was removed and a similar portion of freshly coated and prepared mesh was welded to the anode substrate to replace the torn mesh portion. On restarting of the cell, there was no deleterious effect observed from this repair at the next cell shutdown, on inspection of the copper plate contained on the cathode. Thus, it was concluded that the mesh coated anodes could be readily repaired on site for either the full mesh, or for portions of a full mesh. However, from the five month duration of the test, for economy of operation in anodes for copper electrowinning, i.e., the application of this test, it was concluded that the first mesh was preferred and that welding was preferred for attaching the mesh to the lead base.

During a test cell shutdown, it was observed that stray electrical currents might provide a flash copper coating on the mesh surface of the test anodes. However, when these anodes were returned to service in the test cell and cell start-up initiated, the flash coating was observed to merely return back to the electrolyte. No deleterious effect on the anode, or on the anode performance was observed from this phenomena. Thus, it was concluded that the mesh covered lead electrodes offer the desirable feature of stability against electrode damage that might be occasioned by cell room electrical upsets or outages.

EXAMPLE 2

Several 6¼"×6¼" large coupons of expanded, unflattened titanium mesh, which was the FIG. 1 mesh having an 0.005 inch thickness, were selected. The mesh had LWD and SWD diagonals of the diamond-shaped apertures measuring 3.18 millimeters (mm) and 1.68 mm, respectively. The test coupons were etched in 18 percent hydrochloric acid at 95° C. for five minutes. The mesh coupons were then coated. The coatings were applied to the entire area of the coupons, including both front and back faces.

The etched coupons were coated in a solution of iridium chloride in HCl. Each coupon was dried, then baked at 525°

C. for 10 minutes after the application of each coating layer to provide an iridium coating on the mesh coupons. Four coating layers were applied in this manner. Small 3"×3" coupons were then cut from the large coated titanium mesh coupons and one small coupon was spot welded onto each major face of a 3"×3"×¼" sheet of lead. Two more of the small coated mesh coupons were then used, i.e., one each was fastened to each major face of a 3"×3"×¼" sheet of lead, but the fastening was by means of titanium staples that were hammered into the lead. The lead was a commercially pure lead of about 94 weight percent lead and about 6 weight percent tin with a very minor balance of incidental impurities. The area of each face of the lead sheet under the mesh but exposed to the electrolyte described below was approximately 65 percent of each face as measured by optical image analysis.

The resulting samples were each tested as an anode in an electrolyte of 150 grams per liter (g/l) of $H_2SO_4$. The test cell was maintained at 65±5° C. and operated at a current density of 0.5 kA/m$^2$. After 1062 hours of operation, the cells were shut down and samples of each cell electrolyte were taken and analyzed by the inductively coupled plasma (ICP) technique for lead. The lead in each electrolyte was less that 0.3 milligram per liter (mg/l) of lead, which was the detection limit of the technique.

EXAMPLE 3

Two 6¼"×6¼" large coupons of expanded, unflattened thin titanium mesh, which was the FIG. 3 mesh, were selected. The mesh had a thickness of 0.005 inch and the LWD and SWD diagonals of the diamond-shaped apertures measured ⅝ inch and ⅜ inch, respectively. The test coupons were etched in hydrochloric acid of 18% concentration at a temperature of about 95° C. for several minutes. The mesh coupons were then coated.

The etched coupons were coated with a solution of iridium chloride in HCl. The coating was applied to the front face of each coupon, but there was some wrap around of the coating onto the back face. Coating was done in the manner of Example 2 and four coats were applied. Small 3"×3" coupons were then cut from the large coated mesh coupons and one small coupon was then spot welded onto each major face of a 3"×3"¼" sheet of lead to provide a test sample. The lead sheet was as described in Example 2. The area of each face of the lead sheet exposed to electrolyte was approximately 55 percent of each face as measured by optical image analysis. The sample was tested as an anode in the cell, with the electrolyte, and under the conditions, all as described in Example 2. After 1,062 hours of operation, a sample of cell electrolyte was analyzed in the manner of Example 2 and found to contain less than 0.3 mg/l of lead.

For comparative purposes, a 3"×3"×¼" sheet of the lead was operated as an anode, but the sheet contained no mesh coupons. The anode was thus not representative of the present invention. The sample was tested as an anode in the cell, and under the conditions, as described in Example 2. Samples of the electrolyte were analyzed in the manner of Example 2 and found to contain 4 mg/l of lead for a sample taken after one week of cell operation and 4.7 mg/l of lead for a sample taken after two weeks of cell operation for this comparative anode. Moreover, the cathode of the cell was being visibly plated with lead during cell operation.

In this testing using the mesh coupons on the lead sheet, the mesh masked only about 45 percent of each face of the underlying lead sheet. In the test, the electrolyte contained less that 0.3 mg/l of lead. When the mesh coupons were not used, the electrolyte contained 4.7 mg/l of lead. Thus lead contamination in the electrolyte was reduced by over 95%, even though the lead substrate face exposure was only reduced by about 45%.

EXAMPLE 4

Two 1"×1" coupons of expanded, unflattened thin titanium mesh of grade 1 titanium were selected as test coupons. The coupons provided 1"×1" front and back faces for the mesh. The mesh had a thickness of 0.02" (inch) and the LWD and SWD diagonals of the diamond-shaped apertures (voids) measured ½ inch and ¼ inch, respectively. The two test coupons were etched in 50 volume percent sulfuric acid at 90° C. for ten minutes. The mesh coupons were then coated. Coatings were applied to one 1"×1" face, or front face, of the mesh coupons using brush coating technique. After each coating application, the coupons were air dried and then baked.

Each etched coupon was first subcoated with three coatings of a solution of iridium chloride and HCl in butanol. The coupons were baked at 500° C. for seven minutes after the application of each coating layer. The resulting coupons contained a total of 0.2 gram of iridium expressed as the metal, per square meter (g/m$^2$) of mesh in this subcoating. Each coupon was then subsequently coated with an electrocatalytic coating solution containing ruthenium chloride and HCl, plus tetrabutyl orthotitanate, all in a butanol medium. The coupons were baked at 525° C. for seven minutes after each coating. The steps of applying the coating, drying and baking were repeated 12 times. The coupons contained a total of 11.7 g/m$^2$ of ruthenium, in this coating. Thereafter, there was applied as the top layer, the above described composition of the sublayer. The steps of applying the coating, drying and baking were the same as for the application of the sublayer, but were repeated four times for the top coating. This applied a total of 0.8 g/m$^2$ of iridium in the top coating.

The uncoated 1"×1" face, or reverse face, of each coupon was then sanded to remove any surface titanium oxide that may have been present on the mesh coupons from baking. Each titanium mesh coupon was then pressed into a flat, circular face of a lead plate, with the reverse face of the mesh coupon being pressed into the plate. Each plate was a circular plate measuring 1⅛" in diameter and ¼" in thickness. Portions of the mesh coupon extending beyond the plate were then trimmed away. The exposed face of the lead plate that would be exposed to the electrolyte described hereinbelow, including the face exposed at the edges of the mesh, as well as the area of the plate exposed at the voids of the mesh, was estimated to be about 45 percent of the face area of the plate. The pressing was done at room temperature, using a press pressure of 8 tons per square inch applied for about 10 seconds. The lead substrate was a lead-calcium alloy that contained 0.06 weight percent calcium together with 99.94 weight percent lead.

Each of the resulting lead alloy plates containing an impressed titanium mesh test coupon was tested as an anode in accelerated lifetime test cells. Each cell had an electrolyte of 150 grams per liter of sulfuric acid which was maintained at 50° C. One of the test cells was operated at 1 kA/m$^2$ (kiloamp per square meter) and the other test cell at 1.5 kA/m$^2$. The test cells were maintained online for 100 days and for 86 days, respectively. Both electrodes maintained a highly desirable and serviceable performance through the duration of the tests. The voltage savings for the test cells, compared to lifetime testing in the cells of an anode of the lead-calcium alloy itself was found to be in the range of 300–400 millivolts (mV).

EXAMPLE 5

A 9"×6" coupon of expanded, unflattened thin titanium mesh of grade 1 titanium was selected. The coupons provided 9"×6" front and back faces for the mesh. The mesh had a thickness of 0.02 inch and the LWD and SWD diagonals of the diamond-shaped apertures measured ⅜ inch and ¼ inch, respectively. The test coupon was etched in hydrochloric acid of 18 percent concentration at 95° C. for one hour. The mesh coupon was then coated. Coatings were applied, and baked, all in the manner as described in Example 4.

The etched coupon was first subcoated with three coatings of a solution of iridium chloride and HCl, as disclosed in Example 1 of U.S. Pat. No. 4,528,084, but using n-butanol instead of n-propanol. The coupons were baked at 500° C. for seven minutes after the application of each coating layer. The resulting coupons contained a total of about 0.8 g/m$^2$ of iridium metal in this subcoating. The coupon was then subsequently coated with six coats of the ruthenium chloride solution described in Example 4 and in the manner of Example 4. The coupon contained a total of about 5 g/m$^2$ of ruthenium metal in this coating. Thereafter, there was applied as the top layer, the above described composition of the sublayer. The steps of applying the coating, drying and baking were the same as for the application of the sublayer, and were repeated three times for the top coating. This applied a total of about 0.8 g/m$^2$ of iridium in the top coating.

The uncoated 9"×6" face, or reverse face, of the coupon was then sanded to remove any surface titanium oxide that may have been present on the mesh coupon from baking. The titanium mesh coupon was then pressed into a flat face of a lead plate, with the reverse face being pressed into the plate. The rectangular plate had two 9"×6" major faces and was ¼" in thickness. The exposed face of the lead plate in regard to exposure to electrolyte, including the face exposed at the edges of the mesh, as well as the area of the plate exposed at the voids of the mesh, was estimated to be about 50 percent of the face area of the plate. The pressing was done at an elevated temperature of about 500° F., using a press pressure of 0.5 tons per square inch for 20 minutes. The lead substrate was a lead-calcium alloy that contained 0.06 weight percent calcium together with 99.94 weight percent lead.

The resulting lead alloy plate containing the impressed titanium mesh test coupon was tested as an anode in a copper electrowinning test cell. The cell had a circulating electrolyte of 160 grams per liter of copper sulfate which was maintained at 50° C. The test cell was operated at 0.25 kA/m$^2$. The test cell was maintained online for four weeks. The electrode maintained a highly desirable and serviceable performance through the duration of the test. The voltage savings for the test cell, compared to lifetime testing in the copper electrowinning cell of an anode of the lead-calcium alloy itself, was found to be about 300 mV.

What is claimed is:

1. An electrolytic cell containing a compound electrode and an electrolyte, said electrode comprising a lead electrode base and a metal mesh surface member combined with said lead electrode base, which lead base has a broad surface, with said metal mesh surface member having a multitude of voids, which mesh member is in electrically conductive contact with said lead base, which metal mesh member has a front major face and a back major face, with the back major face of said metal mesh member facing said lead base broad surface and wherein said mesh surface member is combined with said lead base in electrical contact, whereby a portion of said lead base broad surface is retained in exposed form by said multitude of mesh member voids, while said metal mesh surface member at said broad surface projects a coated face from said lead base and presents an active surface in mesh form for said compound electrode.

2. The cell of claim 1 wherein said lead anode base is a generally plate-shaped structure having front and back major faces and an edge, and said mesh member is an uncoated mesh member selected from the group consisting of platinum, or other platinum group metal, platinized metal including platinized titanium and platinized niobium, iron, nickel, aluminum or alloys or intermetallic mixtures of same.

3. The cell of claim 1 wherein said cell is utilized for the oxidation or reduction of one or more of an ionic species or organic species.

4. The cell of claim 3 wherein said ionic species comprises one or more of chloride, bromide, iodide, cerous, ceric, ferrous or ferric.

5. The cell of claim 1 wherein said cell is utilized for the electrodeposition of a metal onto a moving substrate, including electrodeposition for electrogalvanizing, electrotinning, or copper foil deposition.

6. The method of providing an electrode assembly, which assembly has a lead base adapted for use in an electrochemical cell, which lead base in said cell is spaced apart from a cell electrode, with a gap maintained therebetween which contains cell electrolyte, which method comprises:

establishing the lead base with a broad surface whereby said lead base serves as an assembly support structure;

establishing a mesh member with a broad front face and a broad back face;

coating said mesh member front face to provide an active front face;

combining the mesh member with said lead support structure, with the mesh member broad back face facing the broad surface of the lead support structure;

securing the mesh member to said lead support structure in electrically conductive engagement for forming said electrode assembly; and electrically connecting the lead support structure of the electrode assembly to a power supply, the support structure serving as a current distributor member for the mesh member.

7. The method of claim 6 wherein there is established one or more of a new lead base having a new, broad surface serving as a front face for said lead support structure, and a refurbished lead base having a freshly prepared broad surface serving as a front face for said lead support structure.

8. The method of claim 7 wherein said freshly prepared front face is provided by one or more of machining, grinding, blasting, etching and current reversal.

9. The method of claim 6 wherein there is established a mesh member in one or more of sheet form, strip form or wire form and said wire form mesh member is applied, while in one or more of mesh form, or as individual wires, which individual wires form said mesh member while they are combined with the broad surface of said lead support structure.

10. The method of claim 9 wherein said strip form mesh member comprises a multitude of mesh strips, and said mesh strips are applied on said broad surface in one or more of grid form or spaced part, but positioned at least substantially adjacent, one another.

11. The method of claim 6 wherein said mesh member back face engages the lead base broad surface in electrical connection.

12. The method of claim 11 wherein said mesh member is secured to said lead support structure in electrical connection through fastening means.

13. The method of claim 6 including coating said mesh member front face and said mesh member back face.

14. The method of claim 6 wherein said mesh member is secured to said lead support structure by one or more of welding, soldering, molding, brazing, and pressing, including hot pressing, and said welding includes at least one metal weld nugget.

15. The method of claim 14 wherein said mesh member is secured to said lead support structure by welding with a fresh weld nugget of lead or lead alloy.

16. The method of claim 6 wherein said mesh member is secured to said lead support structure by fastening means of one or more of brads, staples, split nails, rivets, studs, screws, bolts or spikes.

17. The method of claim 16 wherein said mesh member is first attached to said fastening means and then secured by said means to said lead support structure.

18. The method of claim 6 wherein said lead support structure is electrically connected through a conductor bar to a power supply.

19. The method of claim 6 further including inserting said electrode assembly in said cell while maintaining a gap between said assembly and said cell electrode.

20. Apparatus for electrodepositing a metal from an electrolyte, the apparatus having a cathode, an anode spaced from the cathode and a gap therebetween containing electrolyte therein, wherein said apparatus has an apparatus electrode as one or more of said anode and said cathode, which electrode has an active electrode member plus a support structure, with said apparatus comprising:

a stationary and rigid lead base for said apparatus electrode, which lead electrode base has a broad surface;

a mesh surface member for said apparatus electrode, which mesh surface member has a broad, coated front face and broad back face, with the broad back face of the mesh surface member facing the broad surface of the lead electrode base;

means securing the mesh surface member to said lead electrode base in electrically conductive engagement, said securing means providing inflexible positioning of said mesh member in relation to said lead electrode base; and power supply means providing electrical power to said lead electrode base whereby said lead base serves as an electrically conductive current distributor member for said mesh surface member.

21. The apparatus of claim 20 wherein said lead base is a generally plate-shaped structure having front and back major faces and an edge, which structure has an at least substantially rectangular shaped front major face and back major face, and said lead base broad surface and said mesh member front and back major faces are all at least substantially flat.

22. The apparatus of claim 21 wherein said lead base has a thickness within the range from about ⅛ inch to about 2 inches.

23. The apparatus of claim 20 wherein said lead surface is enlarged in area over the area of the back face of said mesh member, and the back face of said mesh member has the same surface area as its front face.

24. The apparatus of claim 20 wherein said mesh member is at least as large as the large broad surface of said lead base.

25. The apparatus of claim 20 wherein said lead is one or more of lead or lead alloy comprising lead alloyed with one or more of tin, silver, antimony, calcium, strontium, thallium, indium or lithium.

26. The apparatus of claim 20 wherein from about 5 percent to about 90 percent of said lead base broad surface area remains exposed by voids of said mesh member.

27. The apparatus of claim 20 wherein said mesh member is one or more of a mesh sheet or a mesh strip.

28. The apparatus of claim 27 wherein said mesh member is a wire mesh that is preformed and then combined with, and secured to, said lead support structure, or is formed from individual wires while they are combined with said lead support structure.

29. The apparatus of claim 27 wherein said strip form mesh member is a multitude of mesh strips, and said mesh strips on said lead support structures are at least substantially adjacent one another, in a grid form, or are spaced apart one from the other.

30. The apparatus of claim 20 wherein said mesh member is an expanded metal mesh in unflattened form and has an at least substantially uncoated back face.

31. The apparatus of claim 20 wherein said mesh member is secured to said lead support structure by one or more of welding, soldering, molding, brazing and pressing including hot pressing, and fastening means of one or more of brads, staples, rivets, split nails, studs, screws, bolts and spikes, and said welding includes use of at least one metal weld nugget.

32. The apparatus of claim 20 wherein said mesh member is a metal member and the metal of said member is a valve metal selected from the group consisting of titanium, tantalum, zirconium, niobium, their alloys and intermetallic mixtures.

33. The apparatus of claim 20 wherein said mesh member back face engages said lead base directly in electrical contact.

34. The apparatus of claim 20 wherein said lead base large broad surface is coated.

35. The apparatus of claim 34 wherein said mesh member back face engages said coating, said mesh member is in electrical contact with said lead base through fastening means and said coating is one or more of a polymeric, ceramic, wax and paint coating.

36. The apparatus of claim 34 wherein said base is coated with an electrocatalytic coating and said coating contains a platinum group metal, or metal oxide or their mixtures.

37. The apparatus of claim 34 wherein said electrocatalytic coating contains at least one oxide selected from the group consisting of platinum group metal oxides, magnetite, ferrite, cobalt oxide spinel, tin oxide and antimony oxide, and/or contains a mixed crystal material of at least one oxide of a valve metal and at least one oxide of a platinum group metal, and/or contains one or more of manganese dioxide, lead dioxide, platinate substituent, nickel-nickel oxide or a mixture of nickel plus lanthanum oxides.

38. The apparatus of claim 20 as an anode in an electrolytic cell utilized for the electrowinning of a metal selected from the group consisting of copper, zinc, nickel, tin, manganese, lead, iron or cobalt.

39. The apparatus of claim 20 wherein said mesh member has a broad, coated front face and a broad, coated back face and at least said coated front face is coated with an elctrocatalytic coating.

40. The apparatus of claim 39 wherein said electrocatalytic coating contains a platinum group metal, or metal oxide or their mixtures.

41. The apparatus of claim 40 wherein said mesh member is a platinized valve metal mesh member.

42. The apparatus of claim 40 wherein said electrocatalytic coating contains at least one oxide selected from the group consisting of platinum group metal oxides, magnetite, ferrite, cobalt oxide spinel, antimony oxide, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide or a mixture of nickel plus lanthanum oxides.

43. The apparatus of claim 20 wherein said lead support structure with said mesh member comprises a bipolar electrode and said mesh member coated front face comprises an anode coating.

44. The apparatus of claim 20 wherein said apparatus electrode is an anode in an electrolytic cell utilized for the electrowinning of a metal selected from the group consisting of copper, nickel, zinc, tin, iron, manganese, lead and cobalt.

45. The apparatus of claim 20 wherein said apparatus electrode is an anode in an electrolytic cell utilized for the electroplating of a metal selected from the group consisting of copper, zinc, nickel, tine, iron and manganese.

46. An electrolytic cell containing the apparatus electrode of claim 20.

47. The apparatus of claim 20 wherein said apparatus electrode is an anode in an electrolytic cell Utilized for the electrodeposition of a metal onto a moving substrate, including electrodeposition or electrogalvanizing, electrotinning or copper foil deposition.

48. The apparatus of claim 20 wherein said lead electrode base includes a conductor bar and said conductor bar is electrically connected to said power supply means.

49. The apparatus of claim 20 wherein said apparatus electrode is utilized in an electrolytic cell for the oxidation or reduction of an organic species in an at least substantially aqueous electrolyte.

* * * * *